US006505140B1

(12) United States Patent
Bachrach

(10) Patent No.: US 6,505,140 B1
(45) Date of Patent: Jan. 7, 2003

(54) COMPUTERIZED SYSTEM AND METHOD FOR BULLET BALLISTIC ANALYSIS

(75) Inventor: Benjamin Bachrach, Bethesda, MD (US)

(73) Assignee: Intelligent Automation, Inc., Rockville, MD (US)

( * ) Notice: Subject to any disclaimer, the term of this patent is extended or adjusted under 35 U.S.C. 154(b) by 0 days.

(21) Appl. No.: 09/484,236

(22) Filed: Jan. 18, 2000

(51) Int. Cl.[7] ..... G06F 15/00
(52) U.S. Cl. ..... 702/166
(58) Field of Search ..... 702/167; 356/376; 359/368

(56) References Cited

U.S. PATENT DOCUMENTS

| | | | | |
|---|---|---|---|---|
| 3,792,354 A | | 2/1974 | Slaght et al. | |
| 3,817,096 A | | 6/1974 | Osofsky | |
| 4,127,055 A | | 11/1978 | Hottinger et al. | |
| 4,128,829 A | | 12/1978 | Herbst et al. | |
| 4,379,405 A | | 4/1983 | Engeler et al. | |
| 4,845,690 A | | 7/1989 | Oehler | |
| 4,864,515 A | | 9/1989 | Deck | |
| 4,914,289 A | | 4/1990 | Nguyen et al. | |
| 5,164,998 A | | 11/1992 | Reinsch | |
| 5,349,853 A | | 9/1994 | Oehler | |
| 5,381,236 A | * | 1/1995 | Morgan | 356/376 |
| 5,390,108 A | * | 2/1995 | Baldur et al. | 702/167 |
| 5,413,029 A | | 5/1995 | Gent et al. | |
| 5,477,459 A | | 12/1995 | Clagg et al. | |
| 5,493,301 A | | 2/1996 | Bossoli et al. | |
| 5,512,998 A | | 4/1996 | Puschell | |
| 5,531,113 A | | 7/1996 | Jamison | |
| 5,638,298 A | | 6/1997 | Edwards | |
| 5,654,801 A | | 8/1997 | Baldur | |
| 5,713,239 A | | 2/1998 | Kirschner | |
| 5,778,725 A | | 7/1998 | Kirschner et al. | |
| 5,796,474 A | | 8/1998 | Squire et al. | |
| 5,850,289 A | | 12/1998 | Fowler et al. | |
| 5,859,700 A | | 1/1999 | Yang | |
| 6,317,258 B1 | * | 11/2001 | Watanabe | 359/368 |

* cited by examiner

*Primary Examiner*—John S. Hilten
*Assistant Examiner*—Aditya Bhat

(57) ABSTRACT

A computerized system and method of computerized bullet ballistic analysis is based on acquisition of depth profiles of the surface of a bullet under examination, estimation and compensation for coaxiality errors of the data acquired, and matching normalized data with reference data related to reference bullet(s) or a gun in question to determine whether the bullet under examination was fired from the gun in question. The computerized system includes a mechanism used for holding and rotating a bullet, a depth sensor measuring the depth profile of striations over part of the surface of the bullet, an analog to digital converter for receiving data from the sensor and sending digitized data to the computer where a computer program estimates and compensates the received digitized data for coaxiality errors and compares the normalized data of the bullet under examination with reference data.

70 Claims, 9 Drawing Sheets

| | GUN 1 | | GUN 2 | | GUN 3 | | GUN 4 | | GUN 5 | | GUN 6 | |
|---|---|---|---|---|---|---|---|---|---|---|---|---|
| | T1-01 | T1-02 | T1-03 | T1-04 | T1-05 | T1-06 | T1-07 | T1-08 | T1-09 | T1-10 | T1-11 | T1-12 |
| T1-a | 36.71 | 34.46 | 63.74 | 59.78 | 43.67 | 43.38 | 57.75 | 57.18 | 37.33 | 31.83 | 40.07 | 40.69 |
| T1-b | 30.59 | 34.19 | 57.00 | 49.70 | 42.08 | 45.87 | 68.86 | 60.49 | 28.55 | 33.20 | 39.79 | 37.91 |
| T1-c | 49.26 | 50.29 | 39.20 | 37.33 | 32.41 | 27.68 | 36.62 | 32.00 | 29.17 | 26.56 | 37.90 | 38.36 |
| T1-d | 34.76 | 30.37 | 41.85 | 40.16 | 30.04 | 34.70 | 37.77 | 36.16 | 54.35 | 61.56 | 36.68 | 37.13 |
| T1-e | 28.29 | 28.05 | 44.57 | 47.87 | 41.31 | 53.51 | 47.72 | 44.21 | 30.59 | 31.39 | 47.01 | 38.79 |
| T1-f | 35.19 | 37.84 | 36.71 | 42.26 | 30.89 | 26.62 | 35.73 | 42.42 | 39.45 | 39.27 | 46.90 | 52.06 |

FIG.12

| | GUN 1 | GUN 2 | GUN 3 | GUN 4 | GUN 5 | GUN 6 |
|---|---|---|---|---|---|---|
| | 01-02 | 03-04 | 05-06 | 07-08 | 09-10 | 11-12 |
| T1-a | 35.59 | 61.76 | 43.53 | 57.47 | 34.58 | 40.38 |
| T1-b | 32.39 | 53.35 | 43.98 | 64.47 | 30.88 | 38.85 |
| T1-c | 49.78 | 38.27 | 30.05 | 34.91 | 27.87 | 38.13 |
| T1-d | 32.57 | 41.01 | 32.37 | 36.96 | 57.95 | 36.90 |
| T1-e | 28.17 | 46.22 | 47.41 | 45.97 | 30.99 | 42.90 |
| T1-f | 36.51 | 39.49 | 28.76 | 39.08 | 39.36 | 49.48 |

FIG.13

| | GUN 1 | GUN 2 | GUN 3 | GUN 4 | GUN 5 | GUN 6 |
|---|---|---|---|---|---|---|
| | 01-02 | 03-04 | 05-06 | 07-08 | 09-10 | 11-12 |
| T1-a | 36.71 | 63.74 | 43.67 | 57.75 | 37.33 | 40.69 |
| T1-b | 34.19 | 57.00 | 45.87 | 68.86 | 33.20 | 39.79 |
| T1-c | 50.29 | 39.20 | 32.41 | 36.62 | 29.17 | 38.36 |
| T1-d | 34.76 | 41.85 | 34.70 | 37.77 | 61.56 | 37.13 |
| T1-e | 28.29 | 47.87 | 53.51 | 47.72 | 31.39 | 47.01 |
| T1-f | 37.84 | 42.26 | 30.89 | 42.42 | 39.45 | 52.06 |

FIG.14

COMPUTERIZED SYSTEM AND METHOD FOR BULLET BALLISTIC ANALYSIS

FIELD OF THE INVENTION

The present invention relates to a computer aided ballistic analysis system, and particularly, to a computerized ballistics matching system using the 3D information of a bullet's surface.

More particularly, the present invention relates to a computerized system and method for bullet ballistic analysis based on measurements of depth profiles of striations on the bullet surface, set-up for depth profile acquisition, and software for data acquisition, processing and comparison.

The present invention not only relates to the system for matching bullets fired by known or unknown guns, but it also relates to the system for matching a bullet under investigation to a gun in question by two methods. In particular, to a first method developed for creating a unique "signature" of the gun in question based on depth profiles of control bullets fired from the gun in question, and to a second method based on comparisons of the degree of similarity between the profiles of said control bullets among themselves, and the comparisons of the profiles of said control bullets and the bullet under investigation.

Further, the present invention relates to a software developed for normalizing the acquired 3D data by compensating the same for measurement (coaxiality) errors.

Furthermore, the present invention relates to software developed for the acquisition and matching of the bullet under investigation to another bullet or to a gun in question.

BACKGROUND OF THE INVENTION

The scratches (striations) formed on a bullet by a gun barrel through which the bullet is fired create a signature with enough unique features that it may be matched with other bullets fired by the same gun. The matching process has been manually accomplished for many years using an optical instrument called a comparison microscope. Manual comparisons of bullets can be quite time consuming and such technique is used sparingly unless there is some reason to believe that a bullet from a crime scene was in fact fired from a gun in question.

Recent machines have been built which attempt to automate the process of ballistics analysis. The goal is to enter bullet images into a database and to allow a computer to search the database for matches. Due to the fact that a computer can make such comparisons many times faster than a human, searching large databases is, at least in principle, feasible. The digitized images of bullets and cartridge cases can also be used to provide additional tools which assist firearms examiners in their manual comparison.

For example, U.S. Pat. No. 5,654,801 describes a fired cartridge illumination method and imaging apparatus which includes a light source and a microscope to image impressions on the surface of the cartridge. Images of the impressions are then used for comparative analysis, during which a first image from a test cartridge and a second image from a computer data bank are compared with each other and a maximum correlation value between the first and second images is obtained.

As is common among the current systems capturing data from bullets and cartridges, the device described in the '801 Patent captures strictly visual data which does not distinguish between shallow scratches or deep scratches on the surface of the examined cartridge or bullet. Therefore, important analysis parameters are not considered which lessens matching reliability and reduces the provability of consistent conclusions.

A fundamental problem of all computer aided ballistic analysis systems is that bullets fired from the same gun do not match exactly for a number of reasons, including the facts that the cartridge cases may have different amounts of powder, or that the gun barrel may have been at different temperatures when bullets are fired as compared to the test firing. Due to the fact that the impressions made by a gun on a bullet can differ from firing to firing, all comparison algorithm must necessarily be statistical and cannot look for an exact or even nearly exact match of all striations on the bullet's surface.

Currently, the algorithms which compare bullets have a high false positive match rate. Qualitatively, this means that automatic searching of a large data base of ballistic data which may have tens of thousands of entries is not viable. By using the large data base, there would be so many false matches requiring many comparisons, that essentially no useful information would be obtained.

The current poor false match rate using current algorithms is the result of fundamental problems, most of which are associated with the fact that the data used for the bullet comparisons is 2D data. 3D data is much more reliable and robust than 2D data. Let us consider the physical phenomenon involved in the 2D data capture. A source of light is directed at the bullet's surface, and a camera records the light as it is reflected by that surface. The data capture process is based on the fact that the light reflected by the bullet's surface is a function of the surface features. However, this is an indirect measurement, because it involves a transformation of the incident light into the light recorded by the camera. By comparison, the 3D acquisition process is simply the distance between the surface features and an imaginary plane, and is thus a direct measurement. The disadvantages associated with the indirectness of the 2D data capture are.

Robustness: A significant problem associated with 2D data capture lies in the fact that the transformation relating the light incident on the bullet's surface and the light reflected by it depends not only on the features of the bullet's surface, but also on a number of independent parameters such as the angle of incidence of the light, the angle of view of the camera, variations on the reflectivity of the bullet surface, light intensity, etc. This implies that the captured data (the data recorded by the camera) is dependent on these parameters too. To attempt to eliminate the effect of these parameters on the captured data would be next to impossible (except possibly for light intensity). As a consequence, the 2D captured data is vulnerable to considerable variability, or in other terms, it is non-robust.

Indeterminate conditions: A different kind of problem associated with 2D data capture is the presence of indeterminate conditions in the data. Given an incident light source angle, some of the smaller surface features can be "shadowed" by the larger features. This implies that there will be regions of the surface where the captured data will not accurately reflect the surface features. In mathematical terms, the transformation between the incident light and the reflected light is non-invertible. Furthermore, this is an example where the angle of incidence of the light source can have a critical effect on the captured data, because arbitrarily small changes in the angle of incidence may determine whether smaller features are detected or not. In mathematical terms, the transformation between the incident light and the reflected light is discontinuous with respect to the angle of incidence.

In summary, 2D data capture methodologies can be affected by extraneous variables that can be next to impossible to control. Moreover, because these variables are not measured, their effects on the captured data cannot be compensated for. As a consequence, the normalized data resulting from such capture processes is also vulnerable to significant variability, or in other words, lack of repeatability. The performance of even the most sophisticated correlation algorithms will be degraded in the presence of non-repeatable data. Taking in consideration that the bullet matching problem is quite demanding to begin with, it is not surprising that ballistic matching methodologies based on 2D captured data have had significant difficulties delivering satisfactory performance.

SUMMARY OF THE INVENTION

It is therefore an object of the present invention to provide reliable and highly accurate ballistic analysis on bullets based on 3D data acquisition, particularly, acquisition of depth profiles of the bullet's surface in which the data acquisition process is not influenced by extraneous factors, other than the coaxiality (measurements) errors which are estimated and compensated for.

It is another object of the present invention to provide a computer aided ballistic analysis system with improved matching rate combining:

- a fully automated and highly consistent methodology to a) locate the region of the bullet from which to acquire data, b) to place the data acquisition device (depth sensor) at the optimal distance from the bullet's surface,
- a unique fundamental approach to data acquisition (3D depth profile measurement),
- signal normalizing algorithms developed for removing possible co-axiality errors; and
- unique methodology of data comparison.

It is a further object of the present invention to provide a methodology of matching between a bullet under investigation and a gun in question by two methods. In particular, to a first method developed for creating a unique "signature" of the gun in question based on a composition of (synthesis) depth profiles of one or more reference bullets fired by the gun in question, and by comparing the "signature" of the gun in question thus created to the normalized depth profiles of the bullet under investigation, and to a second method based on comparisons of the degree of similarity between the profiles of said control bullets among themselves, and the comparisons of the profiles of said control bullets and the bullet under investigation. In other words, the bullet under investigation is considered to have been fired by the gun in question if the degree of similarity between the depth profiles of said bullet and a number of depth profiles obtained from the control bullets fired by the gun in question is greater or equal to the degree of similarity between the depth profiles of the different control bullets themselves.

It is yet another object of the present invention to provide comparison software developed to a) Identify and align the normalized depth profiles of the bullets under comparison in all possible relative orientations, b) compare the fine details (striations) of the compared depth profiles for all possible relative orientations, c) provide a quantitative measure of the degree of similarity between the normalized depth profiles of the bullets under comparison for all possible relative orientations, d) identify the particular relative orientation between the normalized depth profiles of the bullets under comparison which displays the most similarity.

In accordance with the present invention, a computerized system for bullet ballistic analysis includes:

- data acquisition unit adapted to acquire depth profiles of the striations on the surface of a bullet,
- normalization software for normalizing the acquired depth profiles by removing measurement errors related to coaxiality problems, and
- comparison software to perform two types of comparisons: a) bullet to bullet comparisons, where the normalized depth profile of the bullet under examination is compared with normalized depth profiles of reference bullets acquired and processed in a substantially similar way, and b) bullet to gun comparisons, where bullet to gun comparisons can be performed in two ways: b.1) by comparing the normalized depth profile of the bullet under examination with a composite normalized depth profile of the gun in question generated by the composition of (synthesis) the normalized depth profiles of a number of bullets fired by the gun in question, b.2) by comparing the degree of similarity between the normalized depth profile of the bullet under examination and the depth profiles of a number of bullets fired by the gun in question against the degree of similarity of the normalized depth profiles of the bullets fired by the gun in question when these bullets are compared among themselves.

It is essential that the comparison software compares not only major features of the surfaces of two bullets, but also inspects the delicate details corresponding to striations on the surface of the bullets, in order to assess whether two bullets have been fired from the same gun. If there is a high degree of similarity of delicate features of the depth profiles, the judgment may be made that both bullets have been fired from the same gun. It is worth mentioning that the magnitude of said fine markings can be as small as 0.1 micrometers.

The depth profile of the surface of a bullet includes so-called land impressions and groove impressions. To be able to continually measure depth profile of the surface of the bullet which include trouble areas, such as transitions between the land impression and the groove impression, high accuracy data acquisition systems such as confocal sensors were used for performing measurements. During measurement, a bullet holder rotates to spin the bullet within range of the data acquisition sensor. The depth sensor must be capable of moving both towards and away from the center or rotation (in order to maintain the surface of the bullet within the sensor range), and along the axis of rotation (in order to make measurements of different cross sections of the bullet).

The data acquired by the system of the present invention based on acquisition of 3D surface information will be contaminated primarily by one type of measurement error, which is coaxiality errors present due to off-centeredness and tilt of the longitudinal axis of the bullet and the axis of rotation thereof. During the processing of the acquired 3D information of the bullet's surface, the coaxiality errors are estimated and compensation is made. Normalization software has been developed to normalize the acquired data to remove the contaminations from the data set to be further processed. In order to estimate the required coaxiality parameters, a cost function is constructed which is parameterized by the coaxiality error parameters, and then is minimized. Once the cost function is minimized, the minimizing values parameterizing the optimal cost function values are the best possible estimate of the true coaxiality errors.

Once the coaxiality parameters have been estimated, these parameters are used to compensate (normalize) the acquired data. Accurate compensation of the contaminated data is essential to enable successful comparison of bullet signatures since it provides for reliable measurement and permits one to obtain consistent data from the bullet's surface.

As the bullet spins around the axis of rotation, the depth sensor scans the surface of the bullet along a circumference thereof. It is essential, for best results, to take measurements of the depth profiles of several cross-sections of the bullet (i.e., at different positions along the longitudinal axis of the bullet). These depth profiles can be either averaged as a single "ring", or can be averaged as different "rings". These "rings" provide a more complete picture of major and fine details of the depth profiles of the striations on the surface of the bullet under examination.

With respect to the reference bullet(s), the surface of which is examined and measured the same way as the surface of the bullet under examination and which undergoes the same data processing as the bullet under examination, the resulting reference information can be either prestored in a data base or may be further compared with the data of the bullet under examination. Alternatively, the measurement and processing of the data profile of the reference bullet(s) may be conducted in the same investigation process simultaneously with the bullet under examination. The reference bullet is the bullet known to be fired from the gun under examination or may be a bullet fired by an unknown gun against which the data of the bullets under examination are to be compared.

In general, the striations impressed on bullets made from different materials (lead, copper, etc.) or different type (hollow point, jacketed, etc.) can be significantly different. Therefore, given a bullet under examination, if a gun suspected of firing said bullet is available, the control bullets used to associate said bullet with said gun should be of a similar material and type to that of the bullet under examination. For this reason, to optimally characterize a gun, different types of bullets should be used as the control bullets, and different distinct signatures should be generated and stored, where each of these signatures is generated by bullets of different material or type.

Viewing the present invention from another aspect, there is provided a method of computerized bullet ballistic analysis which includes the steps of:

(a) providing a data acquisition unit adapted to acquire depth profiles of the bullet;

(b) positioning a depth sensor within optimal range of the bullet's surface;

(c) rotating the bullet in front of the data acquisition unit while displacing the data acquisition unit with respect to the bullet so as to maintain the bullet's surface within range of the depth sensor;

(d) acquiring depth profiles of the surface of the bullet over a predetermined area;

(e) indicating the regions of the bullet which are too damaged to be used for normalization;

(f) normalizing the acquired depth profile to remove coaxiality errors therefrom;

(g1) acquiring and normalizing the depth profile of the surface of a reference bullet to create a bullet signature; and/or (g2) acquiring and normalizing the depth profiles of a number of control bullets to create a gun signature;

(h) comparing the normalized depth profile of the surface of the bullet under examination and the reference bullet(s) and aligning areas thereof having significant similarities;

(i) comparing fine details of the normalized depth profiles of the bullet under examination and the reference bullet(s) within the aligned area thereof.

If the fine detail of the aligned similar areas of the depth profiles under comparison show significant similarities, a judgment may be made that these bullets are fired from the same gun.

The measured bullet may be rotated continuously or stepwise in substantially non-overlapping fashion.

The components of the software developed for the acquisition and matching are the acquisition component and the correlation component, as described in the following:

The acquisition component is responsible for acquiring the data from one or more bullets and preparing it for analysis. In general, this component includes all hardware and software elements required to:

a) Capture data from the specimen. We will refer to this data as "captured data". The captured data is closely associated with the physical phenomenon employed to record the desired features of the bullet's surface. In the case of a photograph, for example, the underlying physical phenomenon is the reflection of light on the object's surface, so the captured data corresponds to the different light intensities at different points on the bullet's surface. In the case of the present invention, the data is the depth of the striations on the bullet's surface. This process is performed by specialized hardware (sensors).

b) Encode (digitize) the data in a format that can be stored and manipulated by a computer. We will refer to this data as "digitized data". This process is also performed by specialized hardware.

c) Process the digitized data in preparation for analysis and comparison. This process usually requires a number of intermediate steps. Among these steps, it is crucial to include steps to indicate the regions of the bullet that are too damaged to be useful for normalization or correlation. This information is used by the normalization and by the correlation algorithms. Also among these steps we include the composition of a gun signature from a number of control bullets fired by the same gun. We will refer to the final processed data set as "normalized data", and by extension we refer to the overall process as "data normalization". At the core of the data normalization process are the normalization algorithms.

The correlation component is responsible for comparing sets of normalized data, and organizing the results for inspection by the user. The name "correlation component" originates from the fact that correlation algorithms are very often used to compare normalized data sets. In general, the correlation component includes all the software elements necessary to:

a) Evaluate the degree of similarity between the normalized depth profiles of two bullets, or between a bullet and a gun. At the core of this process are the correlation algorithms. The correlation algorithms are responsible for matching the depth profile of a bullet under investigation to the depth profile of a reference bullet or to a gun in question by finding all the possible relative orientations between the depth profiles to be compared, comparing the details of the compared depth profiles in all possible relative orientations, evaluating in a quantitative manner the degree of similarity between the details of the compared profiles in all possible relative orientations, and determining both the relative orientation of most similarity, as well as the quantitative degree of similarity between the compared depth profiles in said orientation of most similarity;

(b) If more than two bullets are involved in the comparison, to organize the results of a set of comparisons in some convenient way (for example, to rank by degree of similarity).

(c) To provide the user with tools to verify the results obtained by the correlation algorithms. At the core of this task is a Graphic User Interface (GUI).

With the help of the appropriate acquisition and correlation algorithms, automated search and retrieval systems can perform tasks ranging from preliminary classifications of bullets (by family characteristics, for example), up to ranking a database of bullets against a questioned bullet by degree of similarity. Moreover, computers can perform these tasks in a fraction of the time it would take a firearms examiner.

These and other novel features and advantages of this invention will be fully understood from the following detailed description of the accompanying Drawings.

BRIEF DESCRIPTION OF THE DRAWINGS

FIG. 12 is a table showing the results of blind test of bullets provided by firearms examiner;

FIGS. 13 and 14 show the values of average similarity measure and peak similarity measure attained for the same blind test of bullets provided by firearms examiner;

DETAILED DESCRIPTION OF THE PREFERRED EMBODIMENT

Figure 1:
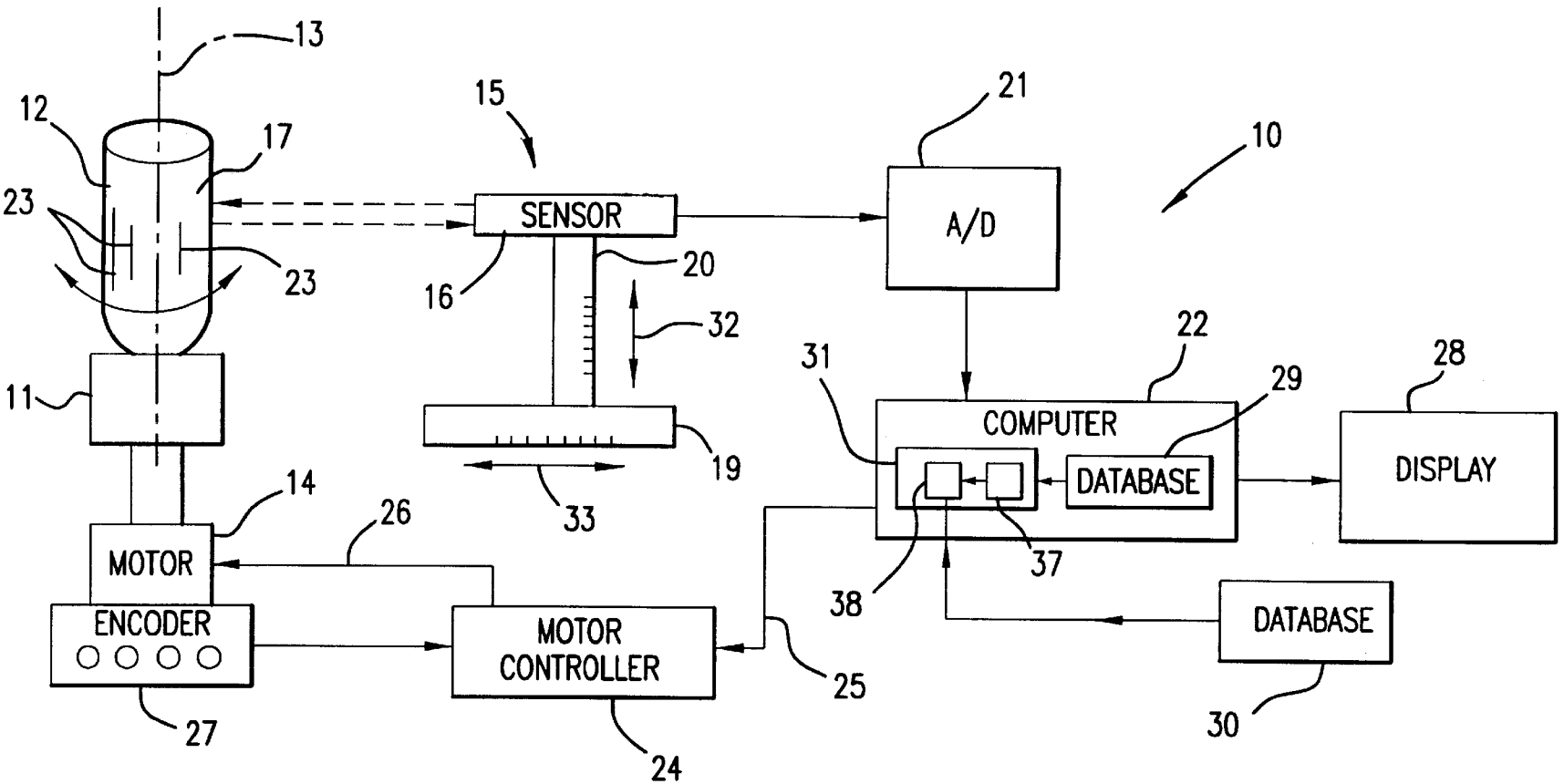
FIG. 1 is a block diagram of the measurement and data processing set-up of the present invention.

Referring to FIG. 1, a computerized system 10 of the present invention includes a mechanism 11 for holding a bullet 12 substantially coaxial with the axis of rotation 13 of a motor 14. System 10 includes a data acquisition unit 15 which has a depth sensor 16 for measuring the distance between the data acquisition unit and the surface 17 of the bullet 12; and data processing means (to be discussed in following paragraphs).

Micro-positioner stages 19 and 20 form part of data acquiring unit 15 and are used for positioning the depth sensor 16 in order to achieve a working range of the surface to be measured (micro-positioning stage 19) as well as to allow height adjustment of the depth sensor 16 with respect to the bullet 12 (micro-positioning stage 20). The micro-positioner stages 19 and 20 may be motor driven or manually actuated with no effect on the essence of the instant invention. In the preferred embodiment, shown in FIG. 1, the micro-positioners 19 and 20 are motor driven.

The acquired data from the depth sensor 16 is fed to A/D converter 21 which digitizes the data measured by the depth sensor 16 and transfers the digitized data to the computer 22 for storing the data. As the bullet 12 continuously rotates or is stepwise driven, measurements are made, and the data is continuously digitized and transferred to the computer 22. When the bullet 12 rotates in a stepwise manner, i.e., the bullet is intermittently stopped and the measurements are taken within a certain area thereof, software is then used to "piece together" a full depth profile of a circumference around bullet 12.

The computer 22 stores depth data of striations 23 on the surface 17 of the bullet 12 received from the A/D converter 21.

A motor controller 24 is coupled to the computer 22 for receiving a signal 25 therefrom in response to which the motor controller 24 provides a control signal 26 to the motor 14. The control signal 26 dictates either constant speed motion of the motor 14, or motion in stepwise fashion, i.e., sequential fixed positions of the bullet 12. The motor 14 provides a rotational torque to rotate the bullet 12 within the holding mechanism 11. In the case of a stepwise rotation of the bullet 12, the motor 14 is a commercially available stepper motor.

The same type of computer/motor controller/motor interaction takes place with micro-positioning stages 19 and 20.

An encoder 27 is physically attached to the motor 14 to provide an accurate position readout to allow the motor controller 24 to maintain constant speed and to allow the motor controller 24 to stop the bullet 12 at fixed positions when necessary. The encoder 27 also generates an index pulse to set the rotation angle "0". The index pulse is connected to the motor controller 24 and to the D/A 21. The computer 22 receiving the index pulse then begins measurements at any desired rotational angle. In the case of a stepper motor, the encoder 27 is not needed since the motor controller "knows" the motor position as a consequence of the number of step signals sent to the motor 14.

The holding mechanism 11 for holding and rotating the bullet coaxial with the center of rotation of the motor 14 may be implemented as a cup filled with a clay type holding material. The bullet 12 is installed preferably coaxial to the cup (centered and vertical) of the holding mechanism 11.

Display 28 is a conventional computer display which is used as a graphical user interface (GUI) to display the depth profile measured and processed.

Data base 29 is a data base for storing information on the bullet under examination, i.e., depth profiles measured.

Data base 30 is an optional element of the present invention representing a data base of the reference bullets.

Alternatively, the unique "signature" of the gun in question (to be discussed in further paragraphs) is stored in the data base 30. This data base 30 can be a distributed data base serving to find a match for the bullet under examination. The data base 30 may be filled with reference information simultaneously with measurements taken during investigation for further reference. Whenever the data base 30 is created, it is mandatory that data stored within the data base 30 is acquired and processed in a significantly similar manner to data related to the bullet under examination.

Figure 15:
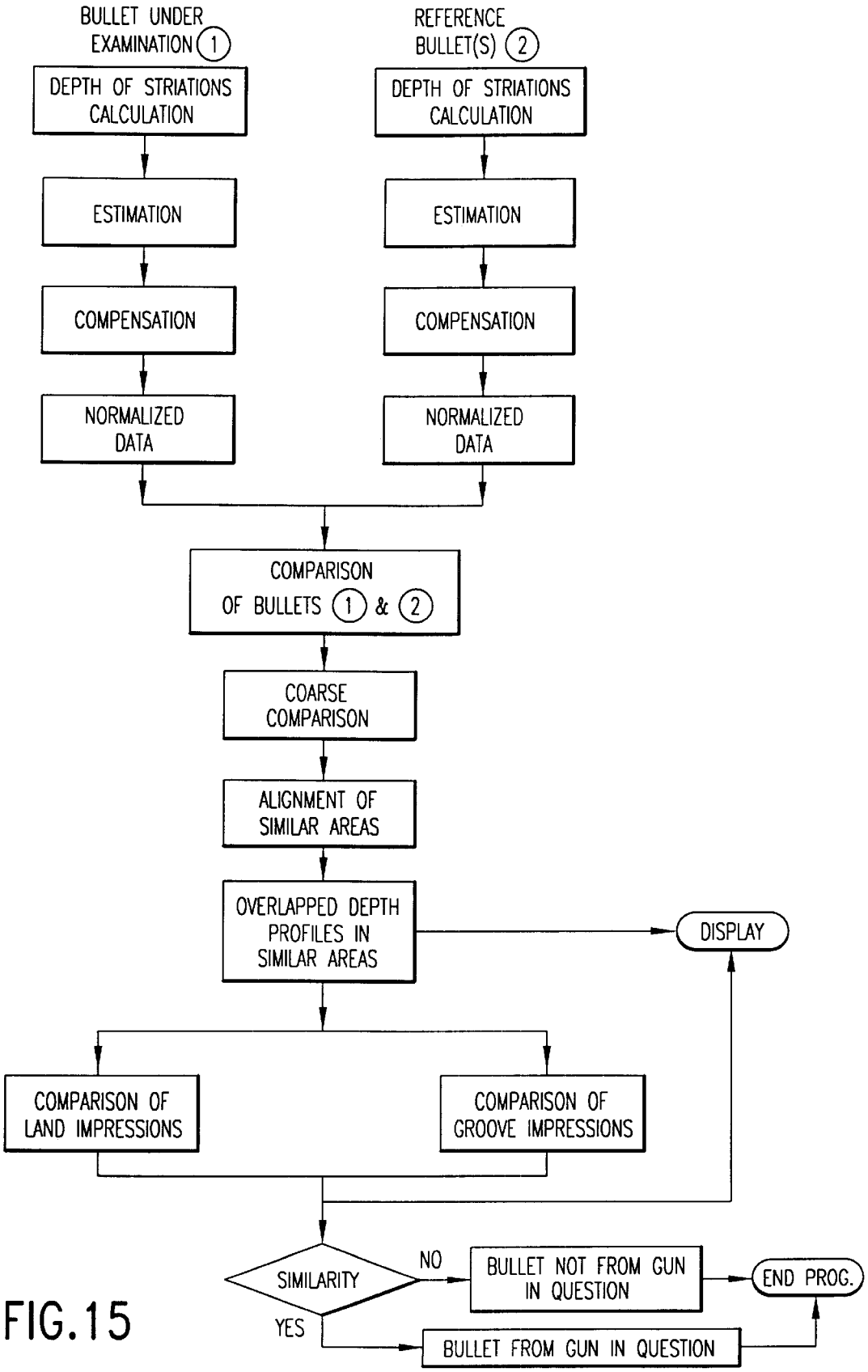
FIG. 15 is a flow chart of the system of the present invention.

Software 31, which is one of the key elements of the present invention includes acquisition and correlation components. The functions of these components, as best shown in FIG. 15, are as follows:

The acquisition component is responsible for acquiring the data from the bullet and preparing it for analysis. In general, this component includes all software elements required to:

a) Control of all hardware components (micro-positioning devices, depth sensor) to capture the depth data from the bullet's surface.

b) Encode (digitize) the data in a format that can be stored and manipulated by a computer. We will refer to this data as "digitized data". This process is also performed by specialized hardware.

c) Process the digitized data in preparation for analysis and comparison. This process usually requires a number of intermediate steps. Among these steps, it is crucial to include steps to indicate the regions of the bullet that are too damaged to be useful for normalization or correlation. This information is used by the normalization and by the correlation algorithms. Also among these steps we include the composition of a gun signature from a number of control bullets fired by the same gun. We will refer to the final processed data set as "normalized data", and by extension we refer to the overall process as "data normalization". At the core of the data normalization process are the normalization algorithms.

The correlation component is responsible for comparing sets of normalized data, and organizing the results for inspection by the user. The name "correlation component" originates from the fact that correlation algorithms are very often used to compare normalized data sets. In general, the correlation component includes all the software elements necessary to:

a) Evaluate the degree of similarity between the normalized depth profiles of two bullets, or between a bullet and a gun. At the core of this process are the correlation algorithms. The correlation algorithms are responsible for matching the depth profile of a bullet under investigation to the depth profile of a reference bullet or to a gun in question by finding all the possible relative orientations between the depth profiles to be compared, comparing the details of the compared depth profiles in all possible relative orientations, evaluating in a quantitative manner the degree of similarity between the details of the compared profiles in all possible relative orientations, and determining both the relative orientation of most similarity, as well as the quantitative degree of similarity between the compared depth profiles in said orientation of most similarity.

b) If more than two bullets are involved in the comparison, to organize the results of a set of comparisons in some convenient way (for example, to rank by degree of similarity).

c) To provide the user with tools to verify the results obtained by the correlation algorithms. At the core of this task is a Graphic User Interface (GUI).

The data acquiring unit 15 is an essential component of the present invention which provides the depth information never before incorporated into systems for ballistics analysis. It was found in the course of development of the present invention, that in order to obtain significant information regarding the striations 23 on the bullet's surface 17 in a non-destructive manner, a non-contacting data acquiring unit 15 is needed with depth resolution on the order of 0.1 microns and lateral resolution on the order of 1 micron. It has also been determined that the depth differential between a land impression and a groove impression best shown in FIGS. 2, 3, and 9, on a bullet surface, is on the order of 100 microns.

When the bullet 12 is rotated by the motor 14, and the depth sensor 16 is positioned to measure a cross-section of the bullet 12, the required measurement range of the data acquiring unit 15 is minimized. Given that the depth difference between a land impression and a groove impression on the bullet surface is on the order of 100 microns, this number dictates the minimum required depth range in order to measure a complete cross-section of the bullet 12 in one single trace.

However, due to the fact that bullets are never perfectly round in cross-section after being fired, and because there are always misalignment imperfections in the measurement process (the bullet under measurement could be improperly centered, or tilted), a depth range of 600 microns is considered the minimum acceptable for this type of measurement. From all systems considered to be used for data acquisition in the system 10 of the present invention which would meet these resolution and range requirements, such as triangulation system, Moire interferometry, Shape-from-Shading techniques, photometric stereo techniques, scanning electron microscopy, confocal microscope, and other confocal sensors, it has been found that confocal based sensors offer the best compromise between accuracy, speed and cost.

Of the depth sensors evaluated, confocal based sensors were the only sensors capable of making measurements of the steep shoulders between land impressions and groove impressions in surface 17. Two commercially available confocal sensors are considered to be used in the data acquisition unit 15. Commercially available confocal sensors include confocal sensors manufactured by Keyence, USA, as well as confocal sensor manufactured by UBM Corporation, Germany. As an example, the sensor manufactured by UBM Corporation has a depth resolution of 0.5 microns over a range of 1000 microns, a lateral resolution of one micron and a sampling rate of 1.2 KHz. More importantly, it is capable of measuring the land/groove transitions.

In the same way as motor 14, the micro-positioners 19 and 20 discussed in previous paragraphs, are motor driven and controlled by computer 22. These micro-positioners are part of a mechanism configured to allow motion of the selected depth sensor 16 along (1) the longitudinal axis of the bullet as shown by arrows 32; (2) in and out with respect to the axis of rotation 13 as shown by arrows 33. Manual adjustment of all computer control devices (motor 14, and micro positioning devices 19 and 20) is also provided via a GUI. There may be some benefit to also providing the means to adjust the position of the acquisition unit 15 along the axis perpendicular to the motion of micro-positioning devices 19 and 20. This would be for initial machine adjustment, and not for routine operation.

Vibration isolation structures to minimize the effect of different sources of vibration in the measurements (not shown in the Drawings) are contemplated in the scope of the present invention.

Descriptive Results

Figure 2:
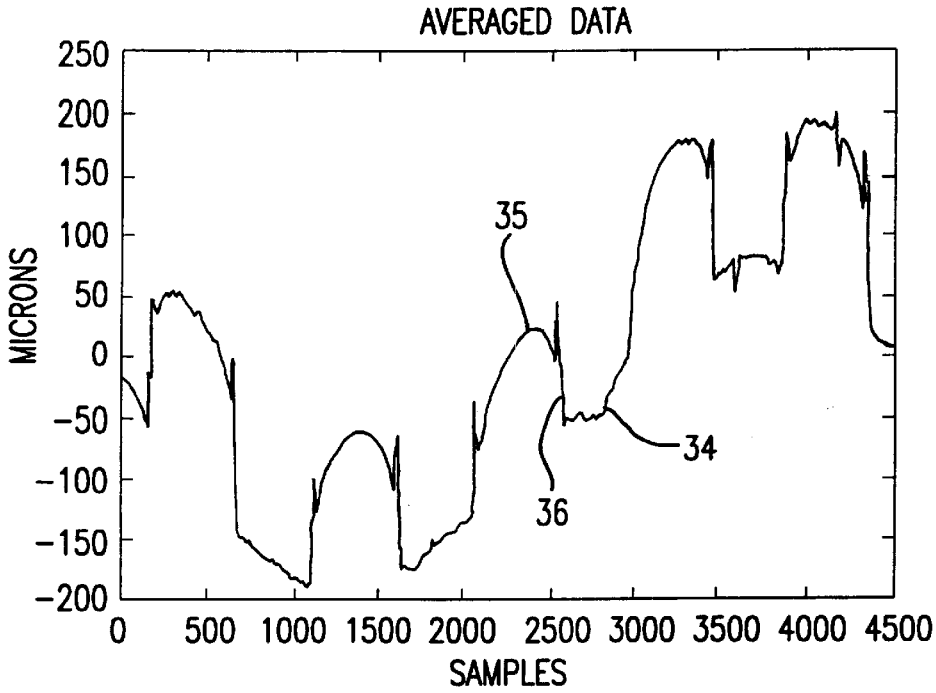
FIG. 2 is a diagram showing averaged depth profiles of the bullet's surface before normalization.

A number of measurements on different bullets using the measurement set-up shown in FIG. 1 have been conducted. FIG. 2 shows a characteristic averaged measurement of a cross-section of a bullet. The bullet in this measurement was a 9 mm, 5R, copper jacketed bullet. In FIG. 2, the horizontal scale shows sample points (lateral resolution for this particular measurement was on the order of 6 microns); while the vertical scale is distance in microns. As shown in FIG. 2, the difference in depth between land impression 34 and groove impression 35 is in the order of 100 microns. The depth resolution is in the order of 2 microns. The sharp transition 36 between land impression 34 and the groove impression 35 adds difficulties to conventional depth measurement systems which are overcome by the system of the present invention. As may be seen in FIG. 2, the overall shape of the bullet's surface seems to follow a sinusoidal function. This distortion of the bullet's surface is primarily due to the fact that the longitudinal axis of the bullet and the axis about which the bullet was rotated do not exactly coincide. Errors are also introduced by the bullet's longitudinal axis being tilted with respect to the axis of rotation 13. All these measurement errors are referred to as coaxiality errors, and will be described in more detail in further paragraphs.

Normalization Algorithms

The measurement imperfections due to off-centeredness and tilt (coaxiality errors) can be modeled as the composition of three transformations on the bullet cross section.

Figure 4:
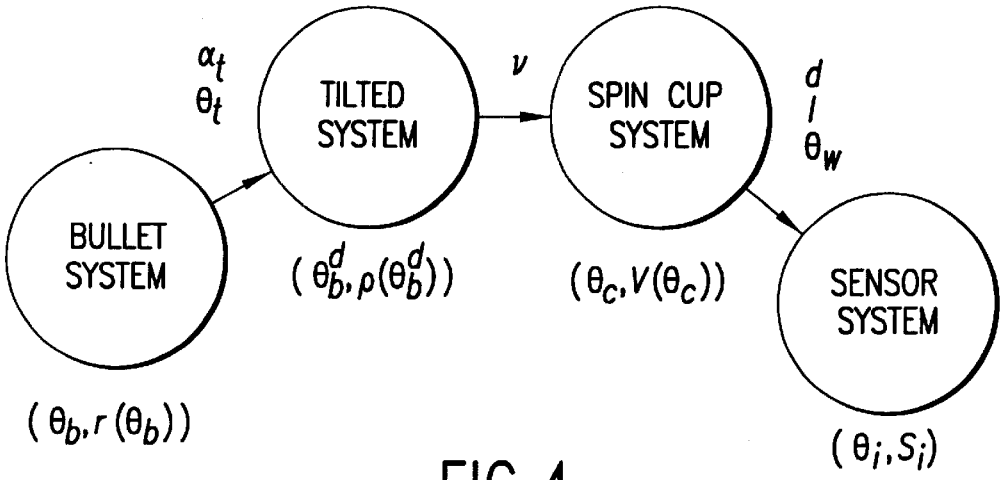
FIG. 4 is a diagram illustrating transformations of the bullet cross-section due to coaxiality errors and parameters involved in them.

These transformations, best shown in FIG. 4, are important because their composition describes the effect of tilt and off-centeredness on the data measured by the depth sensor 16. It is important to understand these transformations in order to identify and compensate for these effects in the normalization of the bullet surface.

Figure 5:
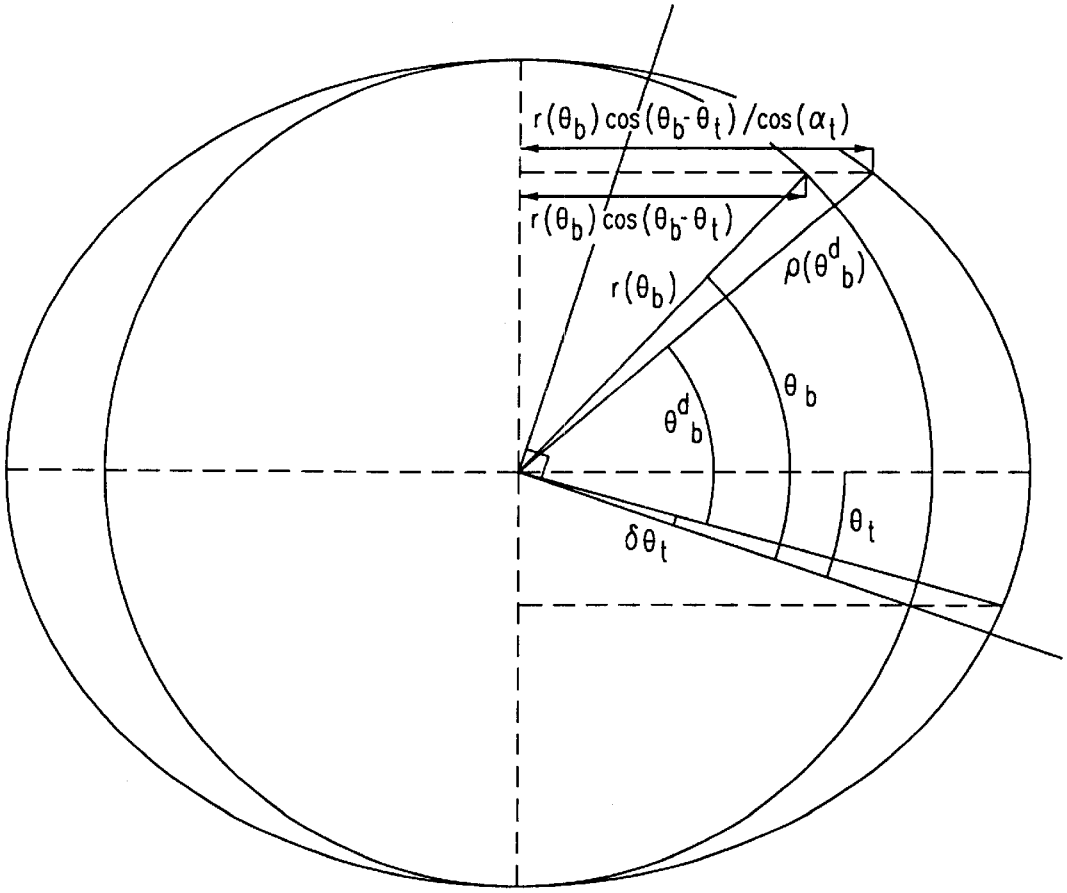
FIG. 5 shows a transformation of the bullet's cross-section due to tilting of the longitudinal axis of the bullet with respect to the axis of rotation.

The first transformation describes the effect of tilt in the bullet's cross section. The cross section of the bullet 12 is described by the polar coordinates $(\theta_b, r(\theta_b))$. As the bullet is tilted, its cross section is deformed as seen in FIG. 5. The coordinates of the resulting deformed cross section are denoted as $(\theta^d{}_b, \rho(\theta^d{}_b))$.

Figure 8:
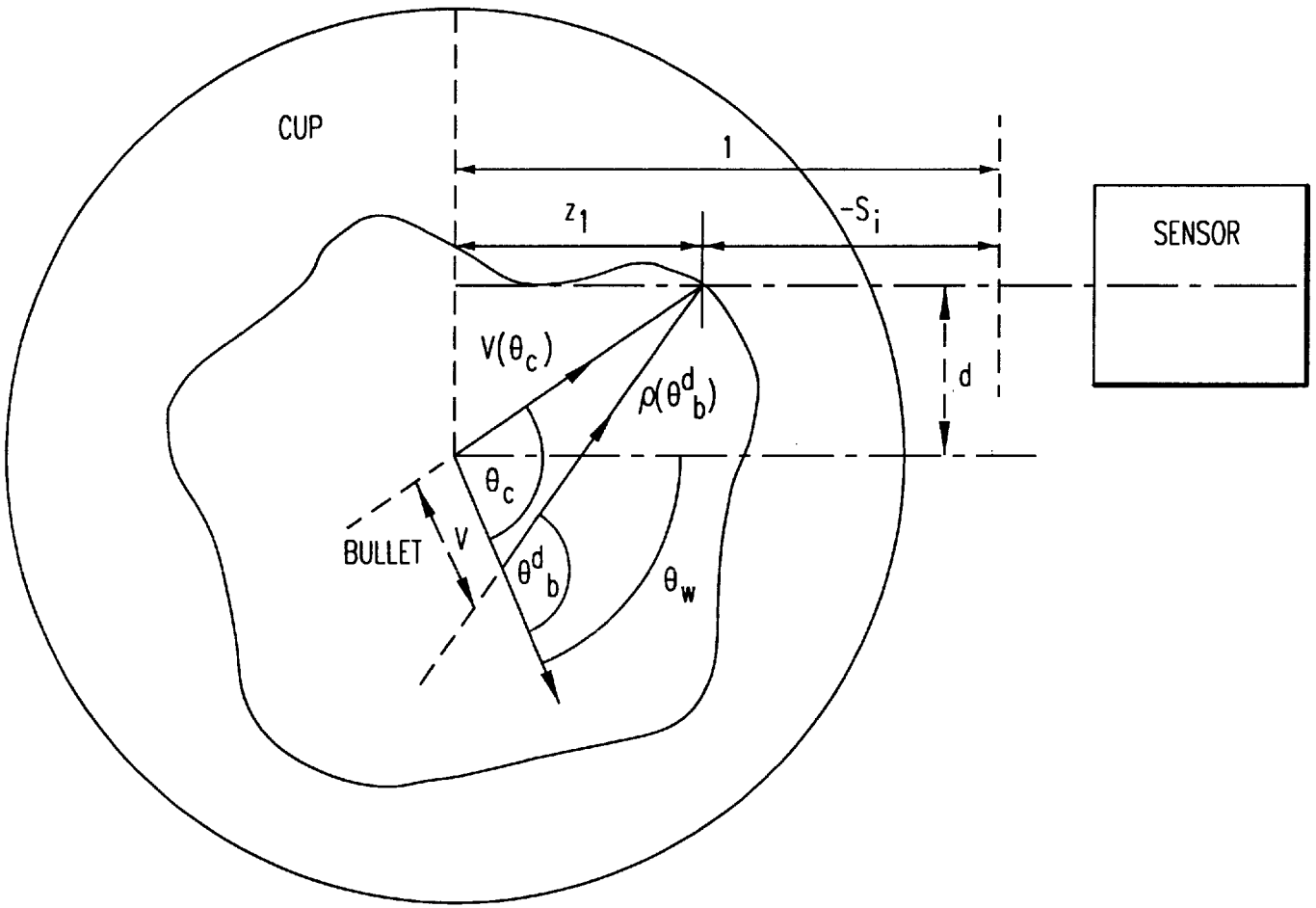
FIG. 8 is a diagram illustrating a transformation of the bullet's cross-section due to off-centeredness and sensor offset.

The second transformation describes the effect of off-centeredness in the bullet's cross section. Because all measurements are made with respect to the spinning cup (bullet holder) 11, the representation of the tilted bullet with respect to the spinning cup is also considered. As shown in FIG. 8, the surface of the bullet can be described with respect to the spinning bullet holder 11 by the coordinate pair $(\theta_c, V(\theta_c))$.

Finally, the third transformation describes the data gathering process from the sensor's point of view as $(\theta_i, s_i)$.

The following discussion refers to the effect of both off-centeredness and tilt in the 3D measurements of a cross section of the bullet. Both forward and inverse transformations are disclosed, where by forward transformation it is meant the transformations between the bullet data to the measured data (in the orientation shown in FIG. 4), while inverse transformations are transformations from the measured data to the bullet data. Thus, their effect on the 3D measurement of a single cross section may be modeled, and further may be easily extended to a number of cross sections. This model is further used to estimate and compensate for coaxiality errors in the 3D measurement.

The following notations will be used in further discussion:

Notation:

| | |
|---|---|
| $\theta_b$ | angular position in bullet reference frame |
| $r(\theta_b)$ | magnitude in bullet reference frame |
| $\alpha_t$ | tilt angle |
| $\theta_t$ | tilt orientation, in bullet reference frame |
| $\theta^d{}_b$ | angular position in tilted reference frame |
| $\rho(\theta^d{}_b)$ | magnitude in tilted reference frame (angular position $\theta^d{}_b$) |
| $\nu$ | off-center magnitude |
| $\theta_w$ | orientation of tilted bullet, in spinning holder reference frame |
| $\theta_c$ | angular position in spinning holder reference frame |
| $V(\theta_c)$ | magnitude of deformed bullet in spinning holder reference frame |
| l | rotation center to measurement plane distance |
| d | sensor off-axis magnitude |
| $z_i$ | distance between surface and rotating plane |
| $\theta_i$ | angular rotation of spinning holder |
| $s_i(\theta_i)$ | depth as measured by sensor. |

Straight Bullet to Tilted Bullet Transformation

Figure 6:
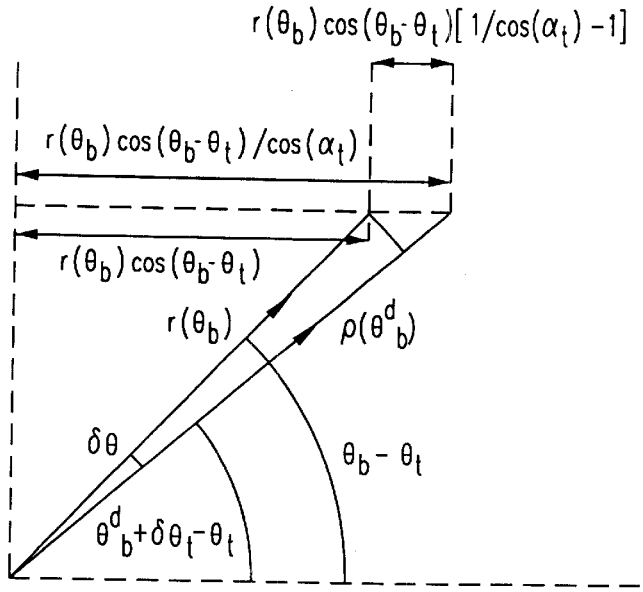
FIGS. 6 and 7 show details of angular correction.

Inherent to this transformation is the assumption that, for small distances, the striations on the bullet's surface run approximately parallel to the bullet's longitudinal axis. Referring to FIGS. 5 and 6, the transformation due to the tilting of a bullet can be modeled as follows:

Forward Transformation

According to FIG. 6, the corrections of the angular position between the straight bullet and the tilted bullet, $\delta\theta$, obey the relationship:

$$\tan(\delta\theta) = \frac{[1-\cos(\alpha_t)]\cos(\theta_b-\theta_t)\sin(\theta_b-\theta_t)}{\cos(\alpha_t)+[1-\cos(\alpha_t)]\cos^2(\theta_b-\theta_t)} \tag{1}$$

where $\delta\theta=\theta_b-\theta^d{}_b-\delta\theta_t$.

Alternatively:

$$\tan(\theta_b^d+\delta\theta_t-\theta_t) = \left[\frac{r(\theta_b)\sin(\theta_b-\theta_t)}{r(\theta_b)\cos(\theta_b-\theta_t)}\right]$$

$$\cos(\alpha_t)=\tan(\theta_b-\theta_t)\cos(\alpha_t) \tag{2}$$

however, this equation is not practical because most software programs compute arctan assuming the angle in question is in the first or fourth quadrant.

The magnitude of the bullet trace in the tilted reference frame satisfies:

$$\rho^2(\theta_b^d) = r^2(\theta_b)\left[\sin^2(\theta_b-\theta_t)+\frac{\cos^2(\theta_b-\theta_t)}{\cos^2(\alpha_t)}\right] \tag{3}$$

Finally applying Eqn. (1), $$\tan(\delta\theta_t) = \frac{[1-\cos(\alpha_t)]\cos(\theta_t)\sin(\theta_t)}{\cos(\alpha_t)+[1-\cos(\alpha_t)]\cos^2(\theta_t)} \tag{4}$$

Inverse Transformation

Given the deformed data and deformation parameters, the characteristics of the straight bullet can be calculated as:

$$\tan(\theta_b - \theta_t) = \frac{\tan(\theta_{aux})}{\cos(\alpha_t)} \tag{5}$$

where $$\theta_{aux}=\theta^d{}_b+\delta\theta_t-\theta_t \tag{6}$$

Figure 7:
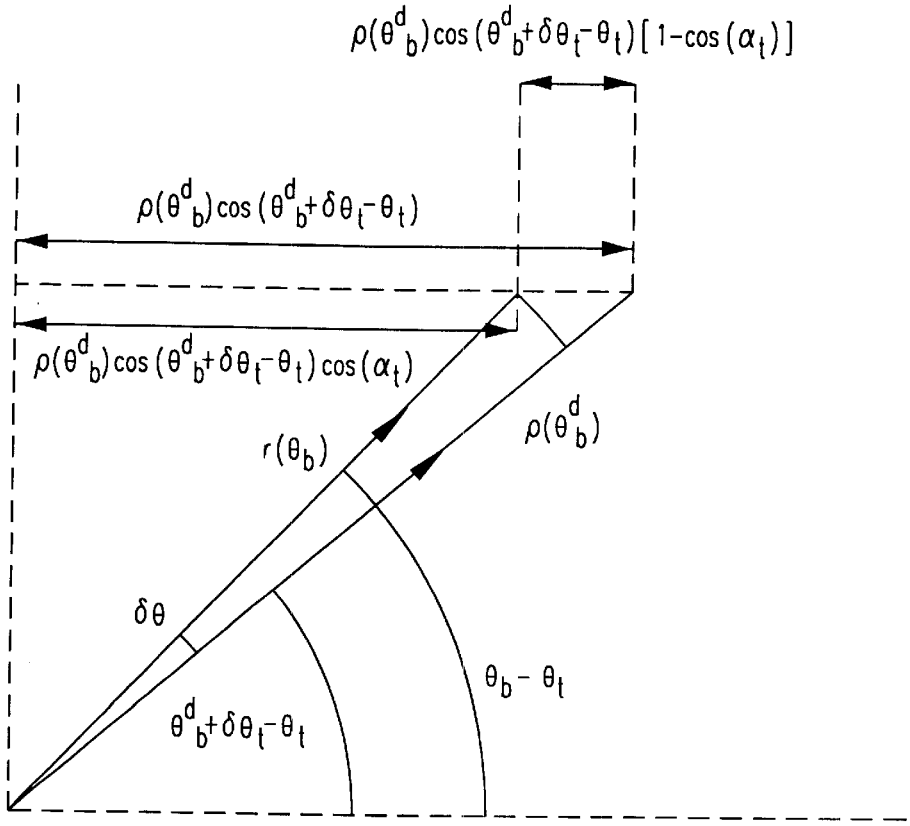

Once again, this equation will in general be impractical in software implementation because most software programs compute arctan assuming that the angle in consideration is within the first or fourth quadrant. Thus, a different relationship must be used. Considering FIG. 7, the following relation is obtained:

$$r^2(\theta_b)=\rho^2(\theta^d{}_b)[\sin^2(\theta_{aux})+\cos^2(\theta_{aux})\cos^2(\alpha_t)] \tag{7}$$

And the angular correction is computed according to:

$$\tan(\delta\theta) = \frac{[1-\cos(\alpha_t)]\cos(\theta_{aux})\sin(\theta_{aux})}{1-[1-\cos(\alpha_t)]\cos^2(\theta_{aux})} \tag{8}$$

Tilted Bullet to Spinning Holder Transformation

FIG. 8 shows the main parameters involved in the transformation of the cross section of the surface and the surface deposition in the spinning holder reference frame.

Forward Transformation

The relationships depicted in FIG. 8 translate into the following functional relationships:

$$V^2(\theta_c)=\rho^2(\theta^d{}_b)+v^2-2v\rho(\theta^d{}_b)\cos(\pi-\theta^d{}_b) \tag{9}$$

and $$\cos(\theta_c) = -\left(\frac{\rho^2(\theta_b^d) - v^2 - V^2(\theta_c)}{2vV(\theta_c)}\right) \tag{10}$$

However, Eqn. (10) is impractical because most software arccos functions do not recognize different quadrants. For this reason, $\theta^d{}_b-\theta_c$ is calculated as follows:

$$\tan(\theta_b^d - \theta_c) = \frac{v\sin(\theta_b^d)}{\rho(\theta_b^d) + v\cos(\theta_b^d)} \tag{11}$$

Inverse Transformation $$\rho^2(\theta^d{}_b)=V^2(\theta_c)+v^2-2vV(\theta_c)\cos(\theta_c) \tag{12}$$

$$\cos(\pi - \theta_b^d) = -\left(\frac{V^2(\theta_c) - \rho^2(\theta_b^d) - v^2}{2v\rho(\theta_b^d)}\right) \tag{13}$$

or, alternatively (and conveniently):

$$\cos(\theta_b^d) \equiv \frac{V(\theta_c)\cos(\theta_c)}{\rho(\theta_b^d)} \tag{14}$$

However, as before, these relationships regarding $\theta^d{}_b$ are not useful in practice. In order to obtain a tangent-based computation of the corrected angular position, apply:

$$\tan(\theta_b^d - \theta_c) = \frac{v\sin(\theta_c)}{V(\theta_c) - v\cos(\theta_c)} \tag{15}$$

Spinning Holder to Sensor System

FIG. 8 shows the main parameters involved in the transformation of the cross section surface and the actual measurement taken by the depth sensor.

Forward Transformation

The relationships depicted in FIG. 8 translate into the following functional relationships:

$$z^2{}_i=V^2(\theta_c)-d^2,\ s_i=z_i-l \tag{16}$$

and $$\theta_i=\theta_c-\sin^{-1}(d/V(\theta_c))-\theta_w \tag{17}$$

These equations describe the transformation between the cross section of the bullet being measured, and the actual measurement output $s_i$, so that given the cross section described by the polar relationship $(\theta^d{}_b, \rho(\theta^d{}_b))$, the measurement taken by the depth sensor will be $(\theta_i,s_i)$.

Inverse Transformation $$z_i = 1 + s_i \tag{18}$$

$$V^2(\theta_c) = z_i^2 + d^2 \tag{19}$$

$$\theta_c = \theta_w + \theta_i + \sin^{-1}(d / V(\theta_c)) \tag{20}$$

where $\theta_w$ determines the initial angular position of the deformed bullet in the spin cup (holder) reference frame, while $\theta_t$ determines the orientation of the principal axis with respect to the line defined by the center of the spinning along the initial angular position $\theta_w$.

Coaxiality Errors Parameter Estimation

The methodology followed to estimate the required coaxiality parameters is a least-squares optimization approach. The main elements of such approach are a cost function parametrized by the coaxiality parameters to be identified, and an optimization algorithm to minimize said cost function as a function of said coaxiality parameters. Absent of additional information (for example statistical information regarding the validity of the available data), once said cost function is minimized, the minimizing values corresponding to the solution of said optimization problem are the best possible estimates of the true coaxiality errors.

Let us discuss how the least-squares cost function is constructed. The first step to obtain the desired cost function is to construct an error vector parametrized by the coaxiality parameters to be identified. Such error vector can be constructed by a number of approaches. We discuss two of them. We refer to these two approaches as the Inverse Transformation Approach and the Forward Transformation Approach. The difference between these approaches is in the construction of the error vector. Once such error vector is constructed, the cost function is simply the root mean square of said vector.

The initial assumption in the construction of the error vector is that the geometric shape formed by the land impressions 34 on the bullet's surface 17 approximates that of a cylinder. Based on this assumption, if expressed in the Bullet System reference frame shown in FIG. 4, the land impressions 34 on the bullet's surface 17 will approximate a constant value corresponding to the radius of said cylinder. This is the fundamental idea to construct the error vectors for both the Forward and the Inverse Transformation Approach.

In the Forward Transformation Approach a vector of constant values (corresponding to the radius of the cylinder defined by the land impressions 34 on the bullet's surface 17) is "forward transformed" from the Bullet System reference frame to the Sensor System reference frame based on the estimated coaxiality parameters. The difference between said forward transformed cylinder and the data corresponding to the land impressions 34 on the bullet's surface 17 constitutes the error vector for this approach. In the Inverse Transformation Approach, the data corresponding to the land impressions 34 on the bullet's surface 17 is transformed from the Sensor System reference frame to the Bullet System reference frame based in the estimated coaxiality parameters. This inverse transformed data is then subtracted from the estimated radius of said cylinder (also to be estimated) to produce the error vector for this approach.

The second major component of the least squares approach is the optimization function. Because the optimization problem resulting from this approach is non-convex, a globally optimal solution to the problem is in general extremely difficult to obtain. However, thanks to the fact that the usual range of the parameters we are identifying is relatively small, and thanks to the fact that a preliminary estimate (initial condition) is relatively easy to obtain, it is possible to obtain a local solution that in most cases seems to correspond to the optimal solution. The optimization algorithm to be used can be one of many optimization algorithms for non-convex optimization problems available in the literature.

Forward Transformation Approach

In the Forward Transformation approach, the cost function is constructed:

$$C_t(\alpha_t, \theta_t, v, d, l, \theta_w, r) = \sqrt{\frac{1}{N_p}\sum_{i=1}^{N_p}(s_i(\theta_i[i]) - \tilde{s}_i(\theta_i[i]))^2} \tag{21}$$

where the value $s_i(\theta_i[i])$ is the result of forward-transforming a perfect cylinder of radius r according to the assumed values ($\alpha_t$, $\theta_t$, v,d,l,$\theta_w$,r), and $s_i(\theta_i[i])$ is the actual data describing the surface defined by the land impressions.

The difficulty in this approach is that the forward transformation is to be obtained at $\theta_i[i]$, i.e. at the exact same phase angles at which the data are obtained. This would require a preliminary computation of the corresponding angles in the spin cup (holder) reference frame that adds complexity to the computations.

Inverse Transformation Approach

In the Inverse Transformation approach, the cost function is constructed as follows:

$$C_I(\alpha_t, \theta_T, v, d, l, \theta_w, r) = \sqrt{\frac{1}{N_p}\sum_{i=1}^{N_p}(r - r(\theta_b[i]))^2} \tag{22}$$

where the value $r(\theta_b[i])$ is the result of inverse-transforming a point ($\theta_i[i]$, $s_i$) based on the assumed values of ($\alpha_t$, $\theta_t$, v,d,l,$\theta_w$, r), and r is the radius of the ideal cylinder describing the surface defined by the land impressions. Optimally, if the cost function equals zero, the exact cylinder (and coaxiality parameters) have been found which produced ($\theta_i[i]$, $s_i$).

The optimization problems resulting from both the forward and the inverse approach are non-convex and do not offer a trivial solution. The software 31 shown in FIG. 1 which is one of the important elements of the present invention solves both these optimization problems.

Compensation of Acquired Data Based on Estimated Coaxiality Parameters

Once the coaxiality parameters have been estimated by solving either the forward or inverse optimization problem, as discussed in previous paragraphs, the software 31 uses these parameters to compensate the acquired data. The acquired data corresponds to the normalized data and will also be referred to as bullet signature.

As a test of the parameter estimation/compensation software 37 which is a part of software 31, a consistency evaluation is performed. As an example, a bullet was positioned in the spin cup (bullet holder) and data was acquired from 5 cross sections of the bullet on a 1 mm ring (i.e. each cross section measurement was made 250 microns apart).

The same bullet was then repositioned in the spin cup, and a similar measurement was made. In this manner data from the same bullet were measured under different conditions, i.e., contaminated by different coaxiality parameters. The logic then proceeded to estimate the coaxiality parameters associated with each of the two data sets, and each data set was compensated according to their respective estimated coaxiality parameters.

Figure 3:
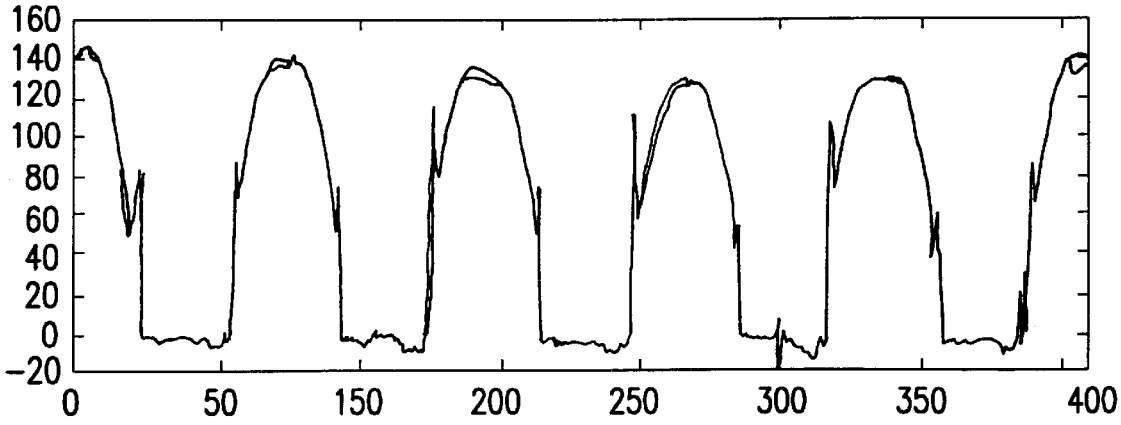
FIG. 3 is a diagram showing a comparison of two normalized depth profiles obtained from the same bullet mounted with different wobble and tilt.

FIG. 3 shows the results of the estimation/compensation test. As can be seen, the compensated (or normalized) data from the two independent measurements looks very consistent indicating that the coaxiality parameters were reliably estimated and the data was accurately compensated. The significant difference between pre and post compensated data can be clearly recognized by comparing the representation of FIG. 2 (which shows one of the data sets, before compensation) with the data displayed in FIG. 3 (which shows one of the data sets after compensation).

As discussed in previous paragraphs, the effect of the coaxiality errors manifests itself not only in the form of a vertical displacement of the data, but it also produces a deformation along the horizontal axis (stretching/shrinking). Accurate compensation of such effects is essential to enable successful comparison of bullet signatures. It is for this reason that estimating and compensating for the coaxiality parameters is so essential as opposed to simply filtering out their effects. Filtering would not compensate for the deformation of the bullet along the horizontal axis.

Correlation Algorithms

Together with the data acquisition and normalization software (coaxiality parameter estimation and compensation), a comparison software 38 has been developed as part of the software 31 of the present invention. At its core, the comparison software 38 receives as an input two bullet signatures (for bullets a and b), together with information indicating which regions of said bullets are too damaged to be used for comparison, one of which is the bullet under examination and another is the reference bullet (s), and returns as an output the relative orientation at which these two bullet signatures appear to be most similar, as well as a similarity measure (denoted s(a,b)). The similarity measure is a function of different correlation values obtained from the data of the bullets under comparison. In order to perform said comparison, the comparison software 38 aligns the signatures of the bullets under comparison in all possible relative orientations, namely, in all orientations such that the land impressions 34 of both bullets overlap, and also the groove impressions 35 overlap. As an example, a pair of bullets with 5 land and groove impressions will have 5 possible relative orientations. Once these relative orientations are identified, any of a number of correlation measures or distance measures (such as time domain correlation, frequency analysis, wavelet analysis, etc.) can be used to evaluate the similarity between the two bullet signatures.

Examples of such correlation are:

Correlation:

$$corr(v_1, v_2) = \frac{v_1' * v_2}{(v_1' * v_1) * (v_2' * v_2)}$$

Where the vectors $v_1$ and $v_2$ contain data from the two different bullets, and the correlation is normalized between −1 and 1, Relative Similarity RelError $$(v_1, v_2) = 1 - \frac{(v_1 - v_2)' * (v_1 - v_2)}{(v_1 + v_2)' * (v_1 + v_2)}$$

where the relative similarity is bounded by 1.

Figure 9:
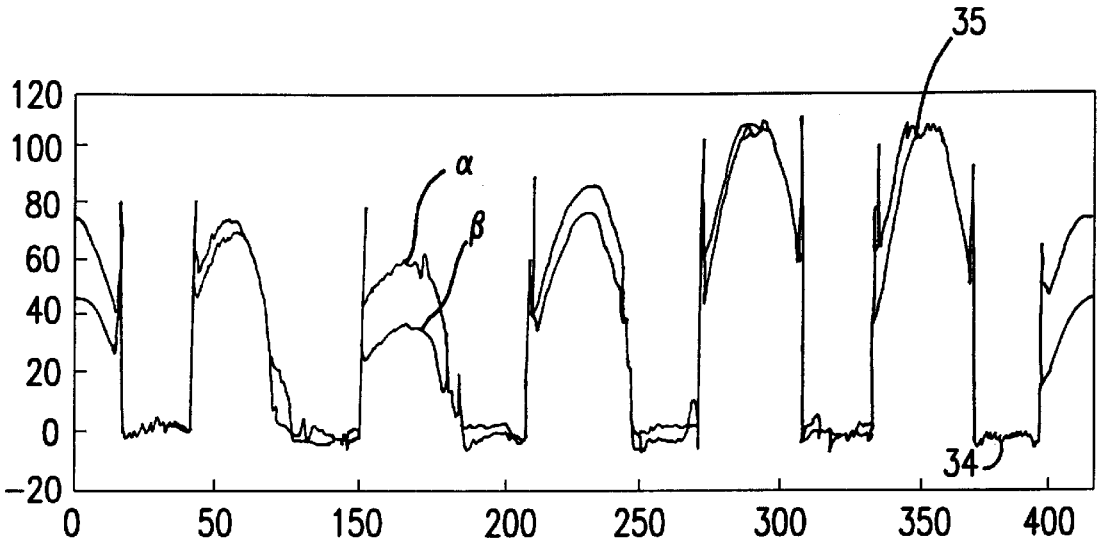
FIG. 9 is a diagram showing a comparison of two bullets fired by the same gun with aligned land and groove impressions in the relative orientation of most similarity.

FIG. 9 shows the results of comparing two bullets (α and β) from the same gun. As can be seen, the major features of these bullets seem to be similar. However, such similarities may be apparent for any pair of similar bullets fired from guns of the same manufacture. In order to assess whether two bullets have been fired from the same gun, it is necessary to inspect the delicate details corresponding to the striations both in the land and groove impressions.

Figure 10:
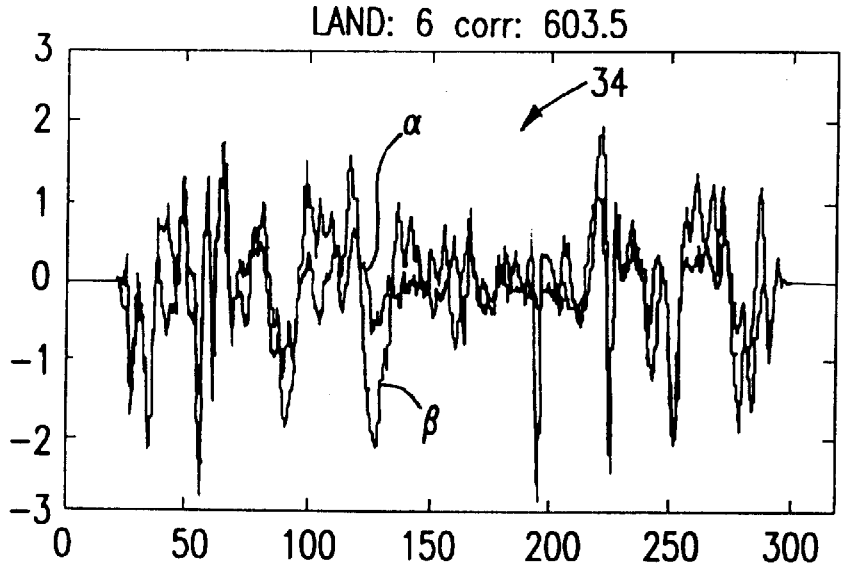
FIG. 10 shows a comparison of delicate details within aligned land impressions of two bullets shown in FIG. 9.

To this effect, the comparison software 38 makes comparisons not only of the major features of a bullet pair, as in FIG. 9, but also of the smaller details found within the land and groove impressions. FIG. 10 shows a comparison of a high pass filtered version of the normalized land impressions 34 in position 6 (the rightmost pair of land impressions shown in FIG. 9), together with a numerical assessment of their similarity (correlation).

Figure 11:
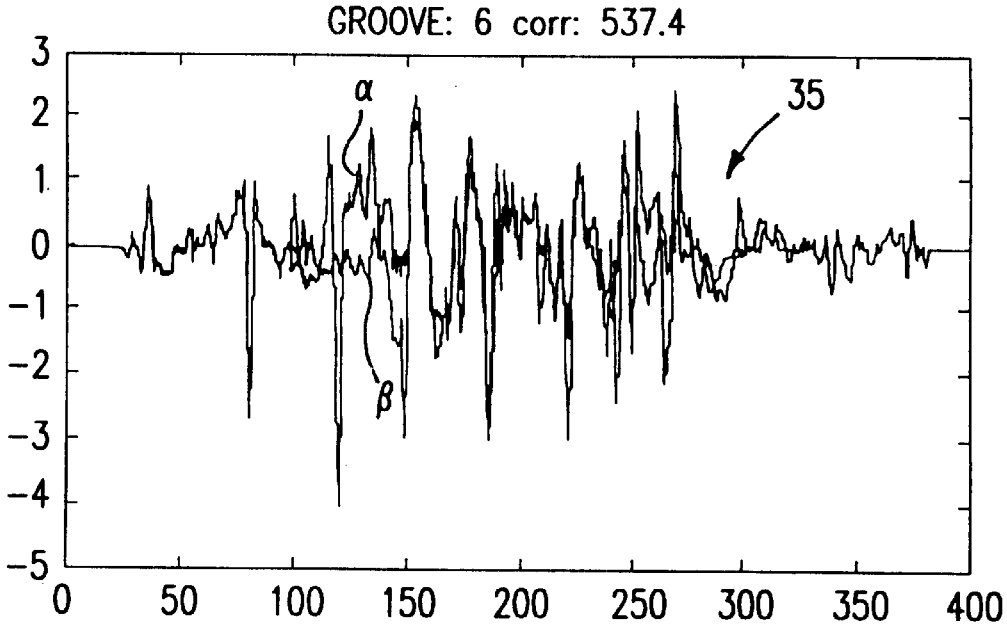
FIG. 11 is a diagram showing comparison of delicate details within aligned groove impressions of two bullets shown in FIG. 9.

It can clearly be seen that there are a number of similarities between these two land impressions 34 which indicate that their striations might have been generated by the same weapon (especially noted on the sides). As an additional example, FIG. 11 shows a comparison of a high pass filtered version of the normalized groove impressions 35 in position 6 (the rightmost pair of complete groove impressions 35 shown in FIG. 9). Once again the similarity is clear and is especially apparent in the center.

In conventional ballistic analysis, the groove impressions are often ignored (or are given secondary importance) in the comparison of bullets. The fact that such degree of similarity was found in groove impressions 35 is thus quite significant, since it might indicate that a potentially neglected source of information can be exploited by the proposed methodology of the present invention.

Bullet to Bullet System Evaluation

As a further test of the acquisition/comparison methodology, a series of tests have been performed with bullets provided by firearms examiners. One such test involved six different guns of the same class characteristics (caliber, number of rifling marks, rifling spin). Two control bullets from each of these guns were also provided. For each gun two bullets were received which were known to be fired by a particular gun. In addition to the control bullets (reference bullets), six questioned bullets were provided: i.e. six bullets whose origin was unknown. The six questioned bullets were compared with all twelve control bullets and a similarity measure was obtained for each comparison.

The results of this comparisons are summaried in the Table shown in FIG. 12. As shown in FIG. 12, the control bullets were labeled T1-O1 through T1-12 which correspond to the horizontal axis. As seen, bullets T1-O1 and T1-O2 were fired by Gun 1, and so on. The questioned bullets were labeled **T1-*a* through T1-*f*, and they correspond to the vertical axis of the Table shown in FIG. 12**. Each entry in the table corresponds to the similarity measure (s(a,b)) between the two bullets found in the corresponding column and row as obtained by the comparison program with the highest attainable similarity number is 100.

For all questioned bullets except **T1-*e*, the shaded entries are those which obtained the highest similarity measure when such bullet was compared against all control bullets. As can be seen, for all the questioned bullets the highest similarity measures were always obtained when compared with the control bullets corresponding to a single weapon. It was thus assessed that these bullets were most likely to have been fired by such weapon. As already mentioned, bullet T1-*e* was an exception, because the first and second highest scores did not correspond to the same gun. Nevertheless, it was assessed that this bullet should be paired with the gun whose control bullet gave the highest similarity measure, i.e., gun 3. When the results were verified with the firearms examiners which provided the bullets, they confirmed that all the questioned bullets were correctly paired with their respective guns, including bullet T1-*e***.

A considerable amount of information was learned from questioned bullet **T1-*e*: even two bullets fired by the same gun can be considerably different. In fact, when bullets T1-05 against T1-06 were compared (which came from the same gun) a surprisingly low similarity measure (s(T1-05, T1-06**)=44.03) was obtained.

Based upon comments made by the firearms examiners who provided the bullets, they confirmed that this is not an uncommon occurrence. Based on their experience, it is not uncommon to obtain rather different looking bullets from the same gun. This is very important, since it points to the fact that a matching scheme should not be designed based on all control bullets being necessarily similar to the questioned bullet.

Gun to Bullet System Evaluation

Ultimately the overall objective is to determine whether a given bullet was fired by a given gun. For this reason, it is relevant to define a measure of similarity between a bullet and a gun instead of between two bullets. This is particularly true when one has multiple control bullets (as in the test case above). For this reason, similarity measures were defined between a given questioned bullet and a given gun. Given a questioned bullet x and a sun G, $S_{avg}(x,G)$ and $S_{peak}(x,G)$ are defined:

$$S_{avg}(x, G) = \underset{y \in G, y \neq x}{\text{avg}} \; s(x, y) \tag{23}$$

$$S_{peak}(x, G) = \max_{y \in G, y \neq x} s(x, y) \tag{24}$$

where the $y \epsilon G$ denotes all bullets y fired by gun G. Thus, $S_{avg}(x,G)$ corresponds to an averaged measure of similarity between bullet x and all bullets fired by gun G (except itself, if x was fired by G), while $S_{peak}(x,G)$ corresponds to the highest similarity measure between bullet x and all bullets fired by gun G (except itself, if x was fired by G).

These two similarity measures are a preliminary attempt to assess the similarity between a bullet and a weapon, as opposed to between two bullets. An optimal definition of similarity between a bullet and gun is a topic of considerable interest. FIGS. 13 and 14 show the values of $S_{avg}(x,G)$ and $S_{peak}(x,G)$ attained for the test in consideration.

In this kind of evaluation, it is also important to assess the degree of discrimination of the comparison algorithm 38. In other words, to compare how high a similarity measure can be obtained for a false match as opposed to how low a similarity measure can be obtained with a true match. To this effect, for each questioned bullet the discrimination ratios d(x), $d_{avg}(x)$ and $d_{peak}(x)$ are defined as follows:

$$d(x) = \frac{\max_{y \notin G(x)} s(x, y)}{\min_{y \in G(x), y \neq x} s(x, y)} \tag{25}$$

where G(x) denotes the gun which fired the bullet x, and y∈G(x) denotes all bullets y fired by the same gun which fired bullet x, $$d_{avg}(x) = \frac{\max_{H \neq G(x)} S_{avg}(x, H)}{S_{avg}(x, G(x))} \text{ and} \tag{26}$$

$$d_{peak}(x) = \frac{\max_{H \neq G(x)} S_{peak}(x, H)}{S_{peak}(x, G(x))} \tag{27}$$

In general, discrimination ratios indicate how close a false match can be to a true match. The lower the discrimination ratio is, the better discrimination between true and false matches is achieved. The different discrimination ratios fulfill two purposes. On one hand, they allow evaluation of the validity of the comparison algorithm 38 and the calculated similarity measures. Second, they allow evaluation as to which is the best similarity measure when it comes to comparing a bullet against a weapon as opposed to a bullet against another bullet.

TABLE 1

| | Min | Max |
|---|---|---|
| d(x) | 0.77 | 1.16 |
| $d_{avg}(x)$ | 0.71 | 0.97 |
| $d_{peak}(x)$ | 0.68 | 0.91 |

Table 1 summarizes the resulting similarity rations for the test in consideration. As shown in this table, a discrimination ratio d(x) between 0.77 and 1.16 was attained.

Bullet T1-*e* was the only questioned bullet for which the discrimination ratio was greater than 1. Table 1 shows that the discrimination ratio improved as an averaged discrimination measure $d_{avg}(x)$ was considered (between 0.71 and 0.97) and further improved as the peak discrimination measure $d_{peak}(x)$ was considered (between 0.68 and 0.91). It is not surprising that the averaged discrimination measure $d_{avg}(x)$ displays better discrimination than d(x), since by definition d(x) considers the worst possible combination of false and true matches. It is noted, however, that the peak discrimination measure $d_{peak}(x)$ displays significantly better discrimination than the averaged discrimination measure $d_{avg}(x)$.

This can be explained by the fact that in general, two bullets from the same gun do not necessarily have overall high similarity. In general, even when dealing with a single pair of bullets, it seems more important to determine whether there are some regions of the two bullets which display significant similarity as opposed to the whole surface of both bullets being similar. In other words, due to the amount of random striations created during the firing of a bullet it appears to be more significant to find regions of similar features as shown in FIGS. 9–11, than to expect the entire surface to be similar. The same kind of reasoning seems to translate to multiple bullets fired by the same gun.

In conclusion, not only does the comparison between two bullet signatures, as in the present invention, deserve considerable attention, but based on the discussion in the previous paragraphs, it is clear that there are ways to correlate a questioned bullet against a gun whenever multiple control bullets from that gun are available. In the test case discussed above, the optimal results were obtained when the peak values of the similarity measure between the questioned bullet and the control bullets were used.

Another approach is the following:

Given a gun in question, a number of control bullets fired by said gun, and a bullet under analysis, the first step is to compare the control bullets among themselves. This comparison will give us an identification of the degree of similarity that can be expected between signatures from bullets fired by the gun in question. This is an important step because the degree of similarity between bullet signatures fired by the same gun varies from gun to gun. Said comparison would provide us with statistical data regarding the expected degree of similarity among bullets fired by said gun. Once this comparison is made, the second step is to compare the bullet under analysis with the control bullets. The bullet under analysis is assumed to have been fired by the gun in question if the statistical characteristics of the degree of similarity between the bullet under analysis and the control bullets are the same as those obtained when comparing the control bullets among themselves.

An alternative approach is to synthesize a composite signature instead of a single bullet signature. This is done by creating a composite bullet signature out of all the control (reference) bullets. Such a composite signature captures all significant features of all the control bullets, and in principle it decreases the randomness of each individual bullet. Although this approach may be used to create a gun signature, one should be careful in that bullets formed of different materials, or manufacture may be imprinted in somewhat different fashion. Thus, to completely characterize a gun, it may be necessary to create composite signatures of bullets formed of a number of different materials.

In conclusion, it is clear that 3D data acquisition, i.e., depth profile of the surface of the bullet, can be successfully used to perform bullet ballistic analysis. 3D data is considerably more reliable and conclusive than 2D data. This is due to the fact that the 2D acquisition process is influenced by extraneous factors, such as light angle, camera angle, lighting intensity, coaxiality errors, surface characteristics, etc. The 3D data acquisition process of the present invention, on the other hand, is only effected by the coaxiality errors, which the developed software of the present invention estimates and compensates for. Since the system of the present invention has the capability to estimate the coaxiality errors, it is possible to compensate the 2D images for such effects in order that the methodology of the present invention may improve the performance also of 2D based computer aided ballistic analysis systems.

The computerized system of the present invention therefore is a completely automated system for bullet ballistic analysis and matching between bullet under examination and reference bullets, as well as between bullet under examination and the gun in question. The process and the system of the present invention can be used globally to find which of possibly thousands of crimes might have been committed by the gun in question. The software developed and used in the present invention provides for fast data acquisition, processing, and matching with very low false match rate.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A computerized system for bullet ballistic analysis, comprising:

a bullet under examination, having striations on the surface thereof;

data acquisition unit adapted to acquire first depth profiles of said striations on the surface of said bullet under examination, normalization means for compensating said first depth profiles of said striations on the surface of said bullet under examination for measurement errors, reference data means providing reference depth profiles of at least one reference bullet, comparison means for comparing said compensated first depth profiles of said striations on the surface of said bullet under examination and said reference depth profiles of said at least one reference bullet, said comparison means including:

means adapted to align areas of said compensated first depth profiles and said reference depth profiles in all possible relative orientations, and fine comparison means for comparing fine details of said compensated and aligned first depth profiles and said reference depth profiles within land and groove impression areas.

2. The computerized system of claim 1, further including decision making means for relating said bullet under examination to said gun in question upon substantial coincidence of said fine details within said areas of the most similarity.

3. The computerized system of claim 1, further including:

a plurality of said reference bullets fired from said gun in question, and means for comparing said reference depth profiles of said plurality of reference bullets, thus creating a unique signature of said gun in question.

4. The computerized system of claim 1, wherein said normalization means compensate said reference depth profiles for measurement errors.

5. The computerized system of claim 3, wherein said unique signature of said gun in question is stored in a data base.

6. The computerized system of claim 1, wherein said first depth profiles and said reference depth profiles exhibit distinct land impressions and groove impressions, said fine details being compared within the land impressions, as well as within the groove impressions.

7. The computerized system of claim 1, further including:

displacement unit adapted to vary relative disposition between said data acquisition unit and said bullet under examination.

8. The computerized system of claim 1, wherein said data acquisition unit includes a confocal sensor.

9. The computerized system of claim 7, further including a bullet holding mechanism coupled to said displacement unit, said displacement unit rotating said bullet holding mechanism.

10. The computerized system of claim 1, further including means for repositioning said data acquisition unit with respect to the surface of said bullet under examination.

11. The computerized system of claim 1, further including means for determining similarity measure of said aligned areas of the most similarity.

12. The computerized system of claim 1, wherein said measurement errors include co-axial errors, and wherein said normalization means further include means for estimation of said coaxial errors.

13. A method of computerized bullet ballistic analysis, comprising the steps of:

(a) providing a bullet under examination having striations on the surface thereof;

(b) providing a plurality of reference bullets fired from a gun in question, each said reference bullet having striations on the surface thereof formed by said gun in question, (c) acquiring first data representative of a depth profile of said surface of said bullet under examination;

(d) normalizing said acquired first data to remove measurement errors therefrom, (e) acquiring second data representative of depth profiles of said reference bullets, (f) normalizing said acquired second data to remove measurement errors therefrom, (g) synthesizing said normalized second data, thereby obtaining a unique signature of said gun in question, (h) comparing said normalized first data and said synthesized normalized second data by aligning regions thereof exhibiting the most similarity, and (i) comparing fine details of said normalized first data and said synthesized normalized second data within said aligned regions thereof.

14. The method of claim 13, further including the steps of:

relating said bullet under examination to said gun in question if said comparison of fine details within said aligned similar regions exhibits a high similarity measure.

15. The method of claim 13, wherein said reference bullets are made of different materials.

16. The method of claim 13, wherein said depth profiles of said bullet under examination and said reference bullets have land impressions and groove impressions, the method further including the steps of:

comparing said fine details within aligned said land impressions as well as within aligned said groove impressions.

17. A method of computerized bullet ballistic analysis, comprising the steps of:

(a) providing a bullet under examination having a first set of striations on the surface thereof;

(b) providing at least one reference bullet having a second set of striations on the surface thereof;

(c) providing a data acquisition unit adapted to acquire depth profiles of either one of said first and second sets of striations;

(d) varying relative disposition between said bullet under examination and said data acquisition unit;

(e) acquiring a depth profile of said first set of striations over a predetermined area on said surface of said bullet under examination;

(f) normalizing said acquired depth profile of said first set of striations to remove coaxiality errors;

(g) performing said steps (d, e, and f) for said at least one reference bullet;

(h) comparing said normalized depth profiles of said bullet under examination and said normalized depth profile of said at least one reference bullet and aligning areas of said normalized depth profiles exhibiting significant similarities, and (i) comparing fine details of said normalized depth profiles within said aligned areas thereof.

18. The method of claim 17, comprising the steps of:

in step (h), calculating similarity measure of said aligned areas of said normalized depth profiles of said bullet under examination and said at least one reference bullet.

19. The method of claim 17, further comprising the steps of:

in step (f), estimating said coaxiality errors and compensating for said estimated coaxiality errors.

20. The method of claim 17, further including the steps of:

in step (d), rotating said bullet under examination about a rotational axis.

21. The method of claim 20, further including the steps of:

permanently rotating said bullet under examination.

22. The method of claim 20 further including the steps of:

step-wise rotating said bullet under examination, in substantially non-overlapping fashion.

23. The method of claim 17, further including the steps of:

in step (d), displacing said data acquisition unit in either of x,y,z directions with respect to said bullet under examination.

24. The method of claim 20, further including the steps of:

in step (e), acquiring said depth profiles of at least two cross-sections of said bullet under examination, and averaging said at least two depth profiles.

25. The method of claim 20, wherein said coaxiality errors are present due to parallel and angled displacement of the longitudinal axis of said bullet under examination with respect to the axis of rotation thereof.

26. The method of claim 17, wherein said step (g) is performed prior to steps (d), (e), and (f).

27. The method of claim 26, wherein said normalized depth profile of said at least one reference bullet is stored in a reference database.

28. The method of claim 17, comprising the steps of:

providing a plurality of reference bullets, performing the step (g) for said plurality of reference bullets, and synthesizing said normalized depth profiles of said plurality of reference bullets.

29. The method of claim 28, wherein said plurality of reference bullets are made of different materials.

30. The method of claim 17, further comprising the steps of:

providing a plurality of reference bullets fired by a gun in question, performing the step (g) for said plurality of reference bullets, comparing said reference bullets among themselves, comparing the bullet under investigation with each of the reference bullets, and making a conclusion, based on these comparisons, whether said bullet under investigation was fired by said gun in question.

31. A computerized system for ballistic analysis of a bullet under investigation having fine details within land and groove impressions on the surface of the bullet due to the bullet being fired by a gun, comprising:

a data acquisition unit adapted to acquire at least one depth profile of the land and groove impressions including the fine details within the land and groove impressions on the surface of the bullet under investigation;

normalization means for compensating the at least one depth profile for measurement errors to obtain at least one normalized depth profile;

means for providing at least one reference depth profile of land and groove impressions including fine details within the land and groove impressions on the surface of at least one control bullet fired by a known gun; and comparison means for comparing the at least one normalized depth profile with the at least one reference depth profile and for generating a quantitative measure of the degree of similarity between the at least one normalized depth profile and the at least one reference depth profile.

32. The computerized system recited in claim 31 wherein said data acquisition unit measures the distance between the surface of the bullet under investigation and an imaginary plane to acquire the at least one depth profile.

33. The computerized system recited in claim 31 wherein said normalization means includes means for compensating the at least one depth profile for coaxiality errors.

34. The computerized system recited in claim 33 wherein said normalization means compensates the at least one depth profile by applying coaxiality parameters thereto.

35. The computerized system recited in claim 34 wherein said normalization means includes means for estimating said coaxiality parameters.

36. The computerized system recited in claim 35 wherein said means for estimating includes a least-squares cost function.

37. The computerized system recited in claim 31 wherein said means for providing includes a reference database including the at least one reference depth profile.

38. The computerized system recited in claim 31 wherein said data acquisition unit is adapted to acquire the at least one reference depth profile and said normalization means includes means for compensating the at least one reference depth profile for measurement errors.

39. The computerized system recited in claim 31 wherein said comparison means includes means for aligning the at least one normalized depth profile with the at least one reference depth profile in a plurality of relative orientations, means for generating a quantitative measure of the degree of similarity between the at least one normalized depth profile and the at least one reference depth profile for the plurality of relative orientations, and means for identifying the relative orientation between the at least one normalized depth profile and the at least one reference depth profile which displays the greatest similarity.

40. The computerized system recited in claim 31 wherein said means for providing includes means for providing a plurality of reference depth profiles of land and groove impressions including fine details within the land and groove impressions on the surfaces of a plurality of control bullets, respectively, fired from the known gun, and said comparison means includes means for comparing the at least one normalized depth profile with the plurality of reference depth profiles, respectively.

41. A computerized system for ballistic analysis of a bullet under investigation having land and groove impressions on the surface of the bullet due to the bullet being fired by a gun, comprising a data acquisition unit adapted to acquire a depth profile of the land and groove impressions on the surface of the bullet under investigation;

normalization means for compensating the depth profile for measurement errors to obtain a normalized depth profile;

means for providing a composite reference depth profile comprising a synthesis of a plurality of reference depth profiles of land and groove impressions on the surfaces of a plurality of control bullets, respectively, all fired from the same known gun; and comparison means for comparing the normalized depth profile with the composite reference depth profile and for generating a quantitative measure of the degree of similarity between the normalized depth profile and the composite reference depth profile.

42. The computerized system recited in claim 41 wherein said means for providing includes a reference database including said composite reference depth profile.

43. The computerized system recited in claim 41 wherein said data acquisition unit is adapted to acquire the plurality of reference depth profiles from the plurality of control bullets, respectively, and said normalization means includes means for compensating the plurality of reference depth profiles for measurement errors.

44. The computerized system recited in claim 41 wherein said comparison means includes means for aligning the normalized depth profile with the composite reference depth profile in a plurality of relative orientations, means for generating a quantitative measure of the degree of similarity between the normalized depth profile and the composite reference depth profile for the plurality of relative orientations and means for identifying the relative orientation between the normalized depth profile and the composite reference depth profile which displays the greatest similarity.

45. The computerized system recited in claim 41 wherein said comparison means includes fine comparison means for comparing fine details within the land and groove impressions of the normalized depth profile with fine details within the land and groove impressions of the composite reference depth profile.

46. A computerized system for ballistic analysis of a bullet under investigation having land and groove impressions on the surface of the bullet due to the bullet being fired by a gun, comprising a data acquisition unit adapted to acquire a depth profile of the land and groove impressions on the surface of the bullet under investigation;

normalization means for compensating the depth profile for measurement errors;

means for providing a plurality of reference depth profiles of land and groove impressions on the surfaces of a plurality of control bullets, respectively, all fired from the same known gun; and comparison means for comparing the plurality of reference depth profiles to one another to obtain a first degree of similarity, for comparing the normalized depth profile to the plurality of reference depth profiles to obtain a second degree of similarity, and for comparing the first and second degrees of similarity.

47. The computerized system recited in claim 46 wherein said comparison means includes means for relating the bullet under investigation to the known gun when the first and second degrees of similarity are substantially the same.

48. The computerized system recited in claim 46 wherein said comparison means includes means for relating the bullet under investigation to the known gun when the second degree of similarity is greater than or equal to the first degree of similarity.

49. The computerized system recited in claim 46 wherein said means for providing includes a reference database including the plurality of reference depth profiles.

50. The computerized system recited in claim 46 wherein said data acquisition unit is adapted to acquire the plurality of reference depth profiles of the land and groove impressions on the surfaces of the plurality of control bullets, respectively, and said normalization means includes means for compensating the plurality of reference depth profiles for measurement errors.

51. The computerized system recited in claim 46 wherein said comparison means includes fine comparison means for comparing fine details within the land and groove impressions of the normalized depth profile with fine details within the land and groove impressions of the plurality of reference depth profiles.

52. A method of computerized ballistic analysis of a bullet under investigation having fine details within land and groove impressions on the surface of the bullet due to the bullet being fired by a gun, comprising the steps of acquiring a depth profile of the surface of the land and groove impressions on the surface of the bullet under investigation including the fine details within the land and groove impressions;

normalizing the depth profile to remove measurement errors therefrom;

accessing at least one reference depth profile of land and groove impressions including fine details within the land and groove impressions on the surface of at least one control bullet fired by a known gun;

comparing the normalized depth profile with the at least one reference depth profile, said step of comparing including comparing the fine details within both the land and groove impressions of the normalized depth profile with the fine details within both the land and groove impressions of the at least one reference depth profile; and generating a quantitative measure of the degree of similarity between the normalized depth profile and the at least one reference depth profile.

53. The method recited in claim 52 wherein said step of accessing includes accessing a database comprising the at least one reference depth profile.

54. The method recited in claim 52 and further including, prior to said step of accessing, the steps of acquiring the at least one reference depth profile from the surface of the at least one control bullet and normalizing the at least one reference depth profile to remove measurement errors therefrom, and wherein said step of accessing includes accessing the thusly normalized at least one reference depth profile.

55. The method recited in claim 52 wherein said step of comparing includes aligning regions of the depth profile with regions of the at least one reference depth profile and identifying aligned regions of greatest similarity.

56. The method recited in claim 55 wherein said step of comparing includes relating the bullet under investigation to the known gun if the aligned regions of greatest similarity exhibit a high degree of similarity.

57. A method of computerized ballistic analysis of a bullet under investigation having land and groove impressions on the surface of the bullet due to the bullet being fired by a gun, comprising the steps of acquiring a depth profile of the land and groove impressions on the surface of the bullet under investigation;

normalizing the depth profile to remove measurement errors;

accessing a composite reference depth profile obtained by synthesizing a plurality of reference depth profiles of land and groove impressions on the surfaces of a plurality of control bullets, respectively, all fired from the same known gun;

comparing the normalized depth profile with the composite reference depth profile; and generating a quantitative measure of the degree of similarity between the normalized depth profile and the composite reference depth profile.

58. The method recited in claim 57 wherein said step of accessing includes accessing a database comprising the composite reference depth profile.

59. The method recited in claim 57 and further including, prior to said step of accessing, the steps of acquiring the plurality of reference depth profiles from the surfaces of the plurality of control bullets, respectively, normalizing the plurality of reference depth profiles to remove measurement errors therefrom, and synthesizing the thusly normalized plurality of reference depth profiles to obtain the composite reference depth profile.

60. The method recited in claim 59 wherein said step of comparing includes aligning regions of the normalized depth profile with regions of the composite reference depth profile and identifying the aligned regions of greatest similarity.

61. The method recited in claim 60 wherein said step of comparing includes comparing fine details within the land and groove impressions of the normalized depth profile with fine details within the land and groove impressions of the composite reference depth profile.

62. The method recited in claim 60 wherein said step of comparing includes relating the bullet under investigation to the known gun if the aligned regions of greatest similarity exhibit a high degree of similarity.

63. A method of computerized ballistic analysis of a bullet under investigation having land and groove impressions on the surface of the bullet due to the bullet being fired by a gun, comprising the steps of acquiring a depth profile of the land and groove impressions on the surface of the bullet under investigation;

normalizing the depth profile to remove measurement errors;

accessing a plurality of reference depth profiles of land and groove impressions on the surfaces of a plurality of control bullets, respectively, all fired from the same known gun;

comparing the plurality of reference depth profiles to one another;

generating a first similarity measure indicative of the degree of similarity between the plurality of reference depth profiles;

comparing the normalized depth profile to the plurality of reference depth profiles;

generating a second similarity measure indicative of the degree of similarity between the normalized depth profile and the plurality of reference depth profiles; and comparing the first and second similarity measures.

64. The method recited in claim 63 wherein said step of accessing includes accessing a database comprising the plurality of reference depth profiles.

65. The method recited in claim 63 and further including, prior to said step of accessing, the step of acquiring the plurality of reference depth profiles from the surfaces of the plurality of control bullets, respectively, and normalizing the plurality of reference depth profiles to remove measurement errors therefrom and wherein said step of accessing includes accessing the thusly normalized plurality of reference depth profiles.

66. The method recited in claim 63 wherein said step of comparing the plurality of reference depth profiles to one another includes aligning regions of the plurality of reference depth profiles with one another and identifying the aligned regions of greatest similarity.

67. The method recited in claim 66 wherein said step of comparing the normalized depth profile to the plurality of reference depth profiles includes aligning regions of the normalized depth profile with regions of each of the plurality of reference depth profiles, respectively, and identifying the aligned regions of greatest similarity.

68. The method recited in claim 67 wherein said step of comparing the plurality of reference depth profiles to one another includes comparing fine details within the land and groove impressions of the aligned regions of the plurality of reference depth profiles and said step of comparing the normalized depth profile to the plurality of reference depth profiles includes comparing fine details within the land and groove impressions of aligned regions of the normalized depth profile and the reference depth profiles, respectively.

69. The method recited in claim 63 wherein said step of comparing includes relating the bullet under investigation to the known gun when the first and second similarity measures are substantially the same.

70. The method recited in claim 63 wherein said step of comparing includes relating the bullet under investigation to the known gun when the second similarity measure is greater than or equal to the first similarity measure.

* * * * *